US009094745B2

(12) United States Patent
Suzuki et al.

(10) Patent No.: US 9,094,745 B2
(45) Date of Patent: Jul. 28, 2015

(54) MOTORCYCLE WITH ACOUSTIC SYSTEM

(75) Inventors: Koji Suzuki, Saitama (JP); Koichi Shimamura, Saitama (JP)

(73) Assignee: HONDA MOTOR CO., LTD., Tokyo (JP)

( * ) Notice: Subject to any disclaimer, the term of this patent is extended or adjusted under 35 U.S.C. 154(b) by 1214 days.

(21) Appl. No.: 11/117,608

(22) Filed: Apr. 29, 2005

(65) Prior Publication Data

US 2005/0265566 A1 Dec. 1, 2005

(30) Foreign Application Priority Data

May 31, 2004 (JP) ..... 2004-162451

(51) Int. Cl.
*H04R 5/02* (2006.01)

(52) U.S. Cl.
CPC ..... *H04R 5/02* (2013.01)

(58) Field of Classification Search
CPC ..... H04R 2499/13; H04R 5/02
USPC ..... 381/99, 302, 86; 359/842; 200/61.54
See application file for complete search history.

(56) References Cited

U.S. PATENT DOCUMENTS

| | | | | |
|---|---|---|---|---|
| 4,502,149 | A * | 2/1985 | Gefvert | 381/182 |
| 5,148,490 | A * | 9/1992 | Draffen | 381/86 |
| 6,057,659 | A * | 5/2000 | Akiyama et al. | 381/98 |
| 6,064,430 | A * | 5/2000 | Lefkowitz | 348/151 |
| 6,225,584 | B1 * | 5/2001 | Ase et al. | 200/61.54 |
| 6,367,202 | B1 * | 4/2002 | Reed et al. | 49/502 |
| 6,545,598 | B1 * | 4/2003 | de Villeroche | 340/438 |
| 6,643,379 | B1 * | 11/2003 | Onglao | 381/351 |
| 2002/0041105 | A1 * | 4/2002 | Shimazaki et al. | 296/37.1 |
| 2003/0142422 | A1 * | 7/2003 | Spitzer et al. | 359/842 |
| 2005/0000747 | A1 * | 1/2005 | Richlen et al. | 180/219 |
| 2005/0135642 | A1 * | 6/2005 | Dry | 381/302 |

FOREIGN PATENT DOCUMENTS

| | | | |
|---|---|---|---|
| JP | 60-27518 | U | 2/1985 |
| JP | 4-127043 | U | 11/1992 |
| JP | 2002-145154 | A | 5/2002 |

* cited by examiner

*Primary Examiner* — Disler Paul
(74) *Attorney, Agent, or Firm* — Birch, Stewart, Kolasch & Birch, LLP

(57) ABSTRACT

To enable a regenerated sound in the high-note range to sufficiently reach an ear of an operator (rider) during travel. A meter display unit is provided for displaying drive information such as a vehicle speed or a travel distance. Left and right speakers are disposed on both sides of the meter display unit for generating regenerated sounds such as English conversation and music. The left speaker includes a left midrange/woofer unit disposed on the left side of the meter display unit for regenerating midrange/low-note sound and a left tweeter unit disposed between the meter display unit and the left midrange/woofer unit for regenerating high-note sounds. The right speaker includes a right midrange/woofer unit disposed on the right side of the meter display unit for regenerating midrange/low-note sound and a right tweeter unit disposed between the meter display unit and the right midrange/woofer unit for regenerating high-note sounds.

17 Claims, 20 Drawing Sheets

MOTORCYCLE WITH ACOUSTIC SYSTEM

CROSS-REFERENCE TO RELATED APPLICATIONS

The present application claims priority under 35 USC 119 to Japanese Patent Application No. 2004-162451 filed on May 31, 2004 the entire contents of which are hereby incorporated by reference.

BACKGROUND OF THE INVENTION

1. Field of the Invention

The present invention relates to a motorcycle acoustic system which can transmit regenerated sound from the low-range to the high-range even during travel to an operator.

2. Description of Background Art

A motorcycle acoustic system is available that generates regenerated sound, such as English conversation or music, from a position adjacent to meters for displaying drive information.

This type of motorcycle acoustic system is satisfactory by causing the regenerated sound to be generated from a specific part of the vehicle body.

A motorcycle acoustic system as described above is known wherein components such as an amplifier and a tuner and a speaker are arranged in a fairing. See, for example, JP-UM-A-60-27518 Page 2, FIG. 3.

Normally, an all-round full-range speaker which covers the entire range (band range) from a low-note to high-note is used as a speaker. However, from the characteristic of the all-round, performances which are specific for the low-note range or the high-note range are not provided.

In general, an acoustic sense for a human being has such a characteristic that it can hardly hear the low-note and the high-note, especially the sound in the high-note range, when the volume is low. In particular, in the case of a motorcycle, since the operator (rider) puts a helmet on, and hears the regenerated sound in an environment having a lot of external noises, he/she may have a further difficulty to hear the sounds in the high-note range.

Since the motorcycle acoustic system in the related art is simply provided with speakers on the left and right sides of the component, transmission of the regenerated sound in the high-note range to the operator (rider) during travel is not taken into consideration.

It is known that the sounds in the high-note range has high directivity.

In an acoustic system 300 of the motorcycle as set forth in JP-UM-A-60-27518,there may be a case in which the sounds in the high-note range can hardly reach the operator's ear depending on the physical constitution or the posture of the operator during travel as characteristics of the sound.

In other words, the motorcycle acoustic system which can transient the regenerated sound in the high-note range sufficiently to the operator (rider) during travel is desired.

SUMMARY AND OBJECTS OF THE INVENTION

It is an object of the present invention to provide a motorcycle acoustic system which can solve the problem wherein sound in a high-note range is hard to hear during travel, and which can allow the regenerated sound in the high-note range to easily reach the ear of the operator (rider) during travel.

The present invention provides a motorcycle acoustic system including a meter display unit for displaying drive information such as a vehicle speed or a travel distance in front of an operator, and left and right speakers on both sides of the meter display unit. The left speaker includes a left midrange/woofer unit disposed on the left side of the meter display unit for regenerating midrange/low-note sound and a left tweeter unit disposed between the meter display unit and the left midrange/woofer unit for regenerating high-note sound. The right speaker includes a right midrange/woofer unit disposed on the right side of the meter display unit for regenerating midrange/low-note sound and a right tweeter unit disposed between the meter display unit and the right midrange/woofer unit for regenerating high-note sound.

It is preferable to enable the regenerated sound in the high-note range to reach (be transmitted to) the operator (rider) sufficiently during travel so that the operator can hear the sound with a realistic sensation.

Accordingly, the left speaker is composed of the left midrange/woofer unit disposed on the left side of the meter display unit for regenerating midrange/low-note sound and the left tweeter unit disposed between the meter display unit and the left midrange/woofer unit for regenerating high-note sound. The right speaker includes the left midrange/woofer unit disposed on the right side of the meter display unit for regenerating midrange/low-note sound and the right tweeter unit disposed between the meter display unit and the right midrange/woofer unit for regenerating high-note sound.

In other words, by composing the speaker with the midrange/woofer unit and the tweeter unit, the sound in the high-note range can easily be regenerated.

Also, by arranging the tweeter unit between the meter display unit and the midrange/woofer unit, the space around the meter display unit can be used effectively.

The present invention provides the left and right tweeter units that are arranged below extensions, which are drawn so as to extend from an upper ridge line of the outline of the meter display unit.

By arranging the left and right tweeter units below the extensions, which are drawn so as to extend from the upper ridge line of the outline of the meter display unit, the tweeter units can be arranged while preventing the outline of the meter display unit from increasing in size.

The present invention provides the left and right tweeter units that are arranged so as to be directed to the operator.

By arranging the left and right tweeter units so as to be directed to the operator, the sound in the high-note range, which has high directivity, can be reliably transmitted to the operator.

The present invention provides an audio device that is connected to the left and right midrange/woofer units and the left and right tweeter units.

By connecting the audio device to the left and right midrange/woofer units and the left and right tweeter units, the operator can enjoy English conversation or music with realistic sensations.

In the present invention, since the speakers are composed of the midrange/woofer units and the tweeter units, the sound in the high-note range can be easily regenerated. Accordingly, the regenerated sound in the high-note range is sufficiently able to reach (be transmitted to) the operator (rider) during travel. In other words, there is an advantage wherein the operator can hear the sound with realistic sensations.

Also, since the tweeter units are disposed between the meter display units and the midrange/woofer units, the space around the meter display unit can be effectively utilized.

In the present invention, since the left and right tweeter units are arranged below the extensions, which are drawn so as to extend in the lateral directions from an upper ridge line of the outline of the meter display unit, the tweeter units can be arranged while preventing the outline of the meter display unit from increasing in size.

In the present invention, since the left and right tweeter units are arranged so as to be directed to the operator, there is an advantage that the sound in the high-note range, which has high directivity, can be reliably transmitted to the operator.

In the present invention, since the audio device is connected to the left and right midrange/woofer units and the left and right tweeter units, the operator can enjoy English conversation or music with a realistic sensation.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
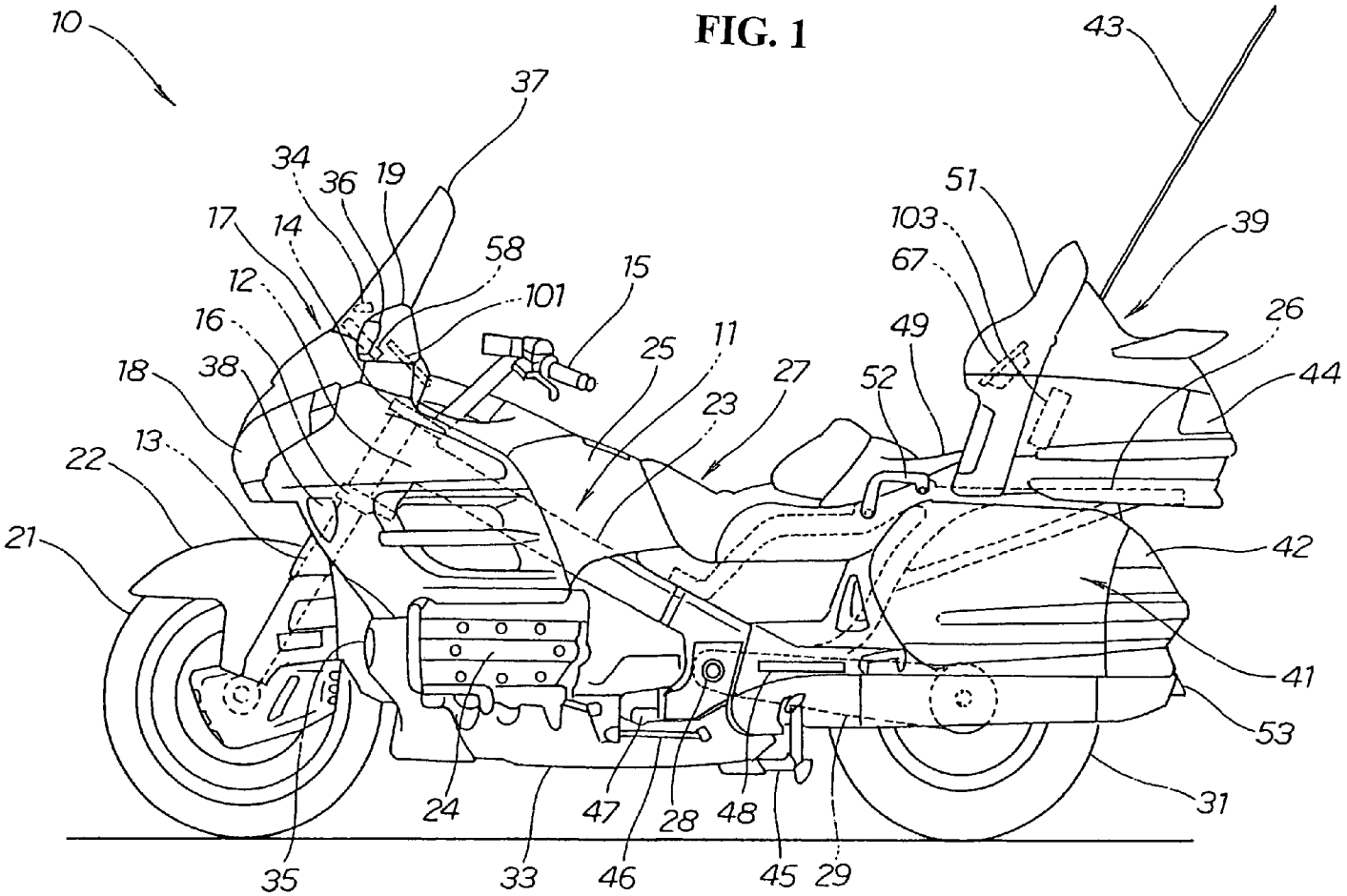
FIG. 1 is a side view of a motorcycle in which an acoustic system and a navigation system according to the present invention are employed.

Referring now to the drawings, a best mode for carrying out the present invention will be described. The drawings are to be viewed in the orientation in which the reference numerals are oriented.

FIG. 1 is a side view of a motorcycle in which an acoustic system and a navigation system according to the present invention are employed, in which a motorcycle 10 includes a head pipe 12 mounted to a vehicle body frame (vehicle body) 11 with a front fork 13 mounted to the head pipe 12 so as to be steerable. A steering handle 15 is mounted to the top bridge 14 of the front fork 13 with a fairing 17 provided forwardly of a top bridge 14 and a bottom bridge 16. Head lights 18, 18 (one of the head lights 18 is not shown) and left and right mirrors 19, 19 (one of the mirrors 19 is not shown) are disposed on the front surface of the fearing 17. A front wheel 21 is mounted to the lower portion of the front fork 13 with a front fender 22 for covering the front wheel 21. A main frame 23 of the vehicle body frame 11 extends rearwardly from the head pipe 12 with an engine 24 disposed in the lower portion of the main frame 23. A fuel tank 25 is disposed on the upper portion of the main frame 23 with a seat rail 26 extending rearwardly from the main frame 23. A vehicle seat 27 is mounted on the seat rail 26 with a rear swing arm 29 extending from the lower rear portion of the main frame 23 via a pivot 28. A rear wheel 31 is rotatably mounted to the rear end of the rear swing arm 29 with a shock absorber (not shown) extending between the real portion of the rear swing arm 29 and the vehicle body frame 11.

In FIG. 1, an under cover 33 is provided together with a GPS antenna 34 (global positioning system antenna), a fog lamp 35, a front winker 36, a wind screen 37 and an air opening 38 opened on the fairing 17 for supplying air to the engine 24. A trunk box 39 is provided together with a saddle bag 41, a rear winker 42, a rod antenna 43, a tail lamp 44, a main stand 45, a sub-stand 46, an operator's step 47, and a passenger's step 48.

The vehicle sheet 27 includes a passenger seat 49 on which a passenger is seated. The passenger seat 49 includes a seat back 51 against which the passenger places his/her back thereon, and grips the grab rails 52, 52 (52 on the far side is not shown).

Figure 2:
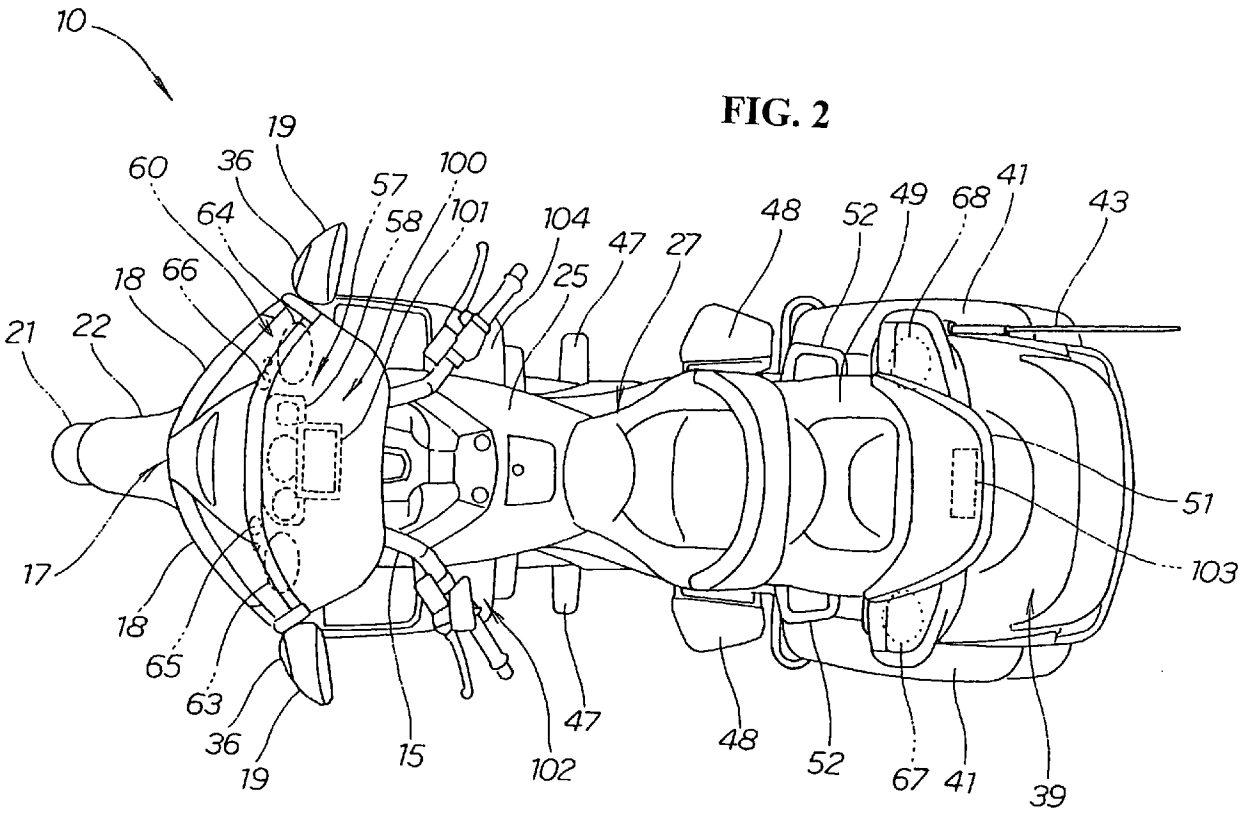
FIG. 2 is a plan view of the motorcycle in which the acoustic system and the navigation system according to the present invention are employed.

FIG. 2 is a plan view of the motorcycle in which an acoustic system and a navigation system according to the present invention is employed. An acoustic system (speaker system) 60 for the motorcycle according to the present invention includes left midrange/woofer units 63, 64 on the left side of a meter display unit (vehicle meter) 58, a left tweeter unit 65 for regenerating high-notes disposed between the meter display unit 58 and the left midrange/woofer unit 63, a right tweeter unit 66 for regenerating high-notes disposed between the meter display unit 58 and the right midrange/woofer unit 64, left and right super woofer units (super woofer speakers) 67, 68 which can regenerate a frequency range lower than the left and right midrange/woofer units 63, 64 and a component 69 as an audio device for causing the units 63-68 to generate regenerated sound disposed in the trunk box 39.

Since the acoustic system (speaker system) 60 for the motorcycle includes the component (audio device) 69 connected to the left and right midrange/woofer units and the left and right tweeter units, a listener can enjoy English conversation or music with a realistic sensation.

The component 69 represents a device having the functions of a tuner, a CD (compact disk) deck, a MD (mini disc) deck, a cassette deck, and an amplifier.

By providing the vehicle seat 27 on which the operator is seated, then placing the trunk box (trunk space) 39 rearwardly of the vehicle seat 27, and then disposing the super woofer units 67, 68 which can regenerate the frequency range lower than the left and right midrange/woofer units (midrange/woofer speakers) 63, 64 in the trunk box 39, a sound having a wide frequency range can be regenerated without loosing the spatial efficiency around the fairing 17 (or a meter panel 57).

A motorcycle navigation system 100 according to the present invention is a system in which a navigation display unit 101 is arranged rearwardly of the meter display unit 58. An operating element 102 is divided into sections and is arranged around the steering handle 15 and an upper panel 104. A control unit (controller) 103 is stored in the trunk box 39, which will be described in detail in conjunction with FIG. 12 to FIG. 28.

Figure 3:
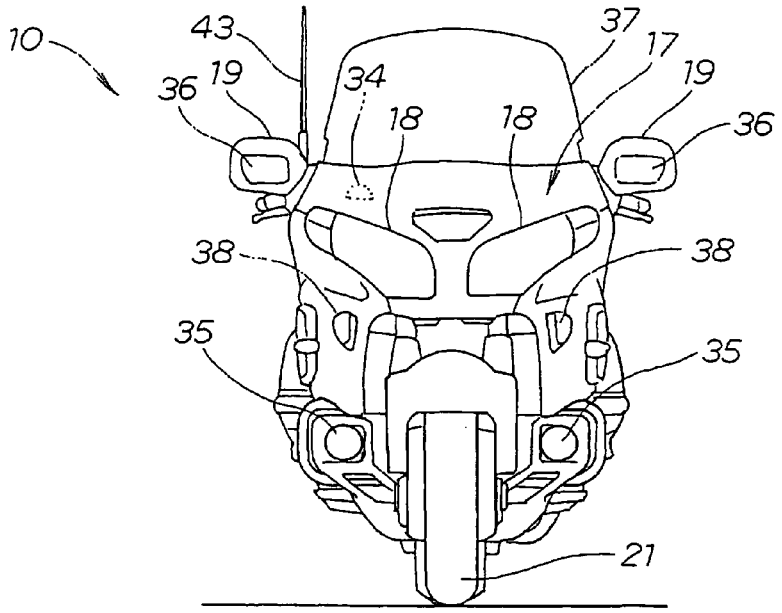
FIG. 3 is a front view of the motorcycle in which the acoustic system and the navigation system according to the present invention are employed.

FIG. 3 is a front view of the motorcycle employing the acoustic system and the navigation system according to the present invention, showing that the GPS antenna 34 is arranged at the front of the vehicle body, the left and right fog lamps 35, 35 are arranged on the lower portion of the vehicle body, the head lights 18, 18 are arranged on the fairing 17, the left and right mirrors 19, 19 are disposed on the fairing 17, the left and right front winkers 36, 36 are integrally built in the mirrors 19, 19, and the left and right air openings 38, 38 are provided on the fearing 17.

The GPS antenna 34 is preferably a tip antenna, a batch antenna, or a helical antenna, which can be built in the meter panel (instrument panel) 57 or the fairing 17.

Figure 4:
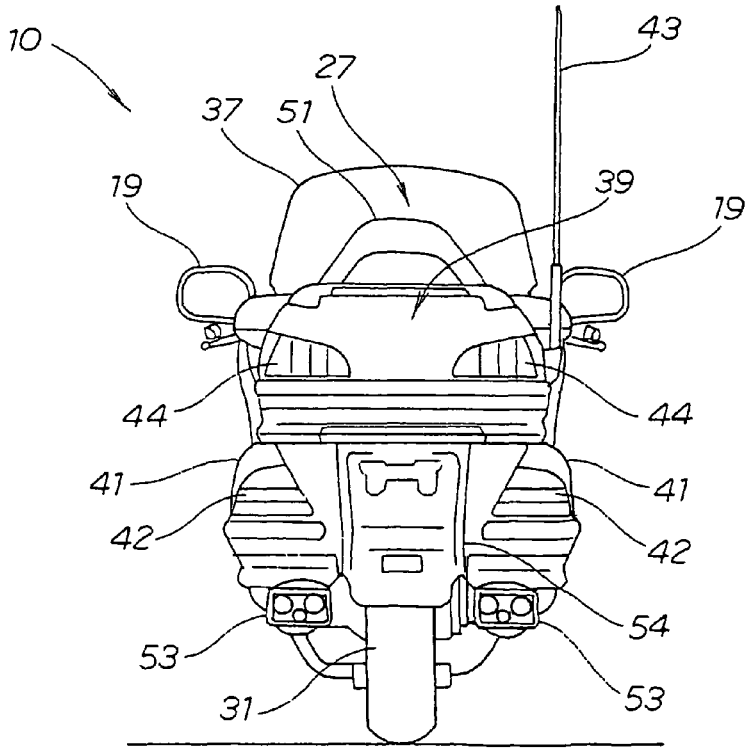
FIG. 4 is a back view of the motorcycle in which the acoustic system and the navigation system according to the present invention are employed.

FIG. 4 is a back view of the motorcycle employing the acoustic system and the navigation system according to the present invention, showing that the trunk box 39 is disposed at the rear center of the vehicle body with the left and right saddle backs 41, 41 being disposed on both sides of the trunk box 39. The left and right rear winkers 42, 42 are disposed on the back surfaces of the left and right saddle bags 41, 41, the rod antenna 43 is disposed on the right side of the trunk box 39 and the left and right tail lamps 44, 44 are disposed on the back surface of the trunk box 39. Left and right mufflers 53, 53 are disposed on the lower portion of the vehicle body with a rear wheel 31 being covered by the rear fender 54.

Figure 5:
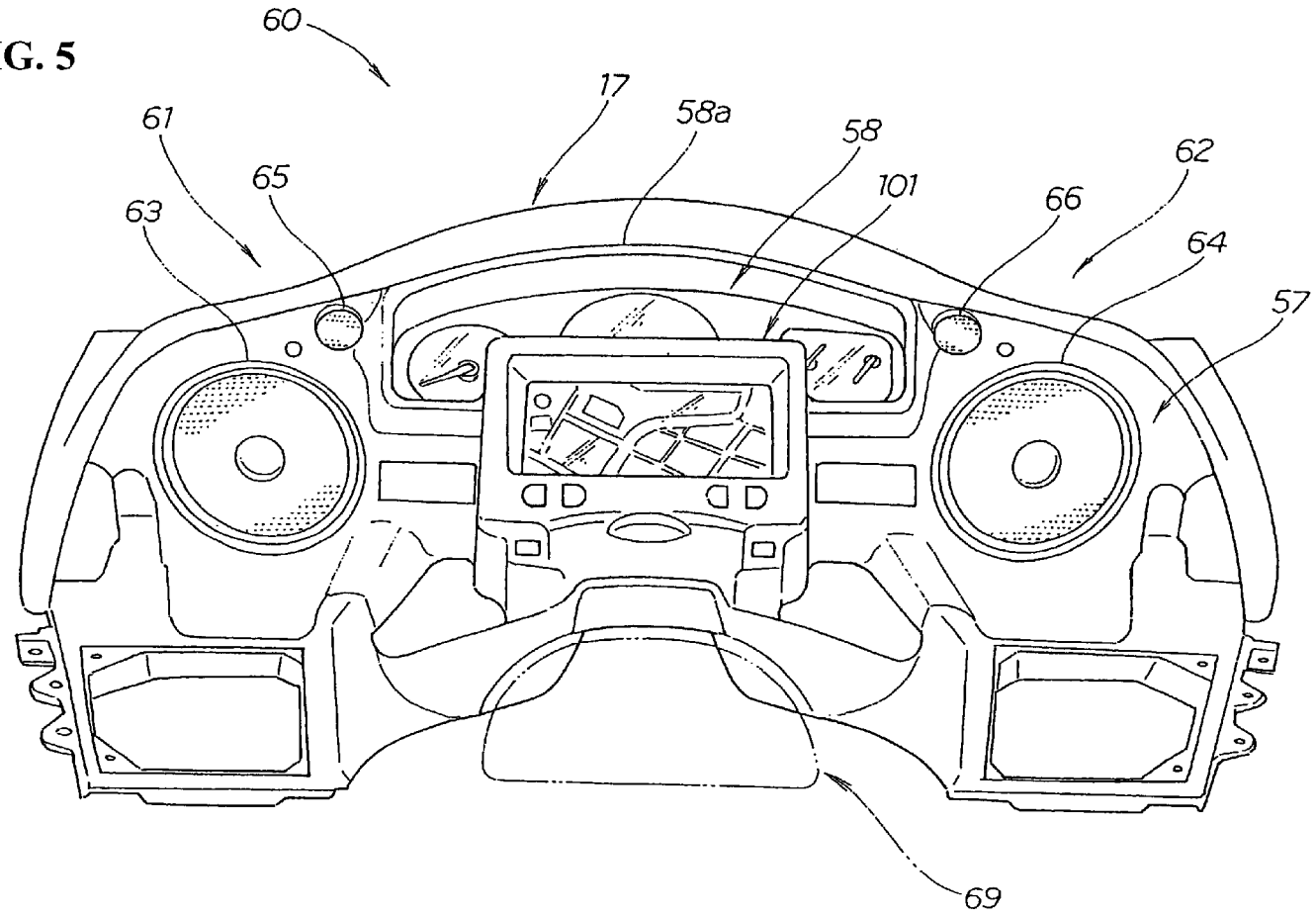
FIG. 5 is a perspective view of the acoustic system for the motorcycle according to the present invention.

FIG. 5 is a perspective view of the acoustic system for the motorcycle according to the present invention. The acoustic system 60 for the motorcycle 10 (see FIG. 1) includes the meter display unit 58 for displaying drive information such as a vehicle speed or a travel distance provided in front of the operator, and left and right speakers (speaker systems) 61, 62 for producing regenerated sound such as English conversation or music provided on both sides of the meter display unit 58. The left speaker (speaker system) 61 includes the left midrange/woofer unit (midrange/woofer speaker) 63 disposed on the left side of the meter display unit 58 for regenerating the midrange and bass sound, the left tweeter unit (tweeter speaker) 65 disposed between the meter display unit 58 and the left midrange/woofer unit 63 for regenerating high-notes. The right speaker (speaker system) 62 includes the right midrange/woofer unit 64 disposed on the right side of the meter display unit 58 for regenerating the midrange and bass sound and the right tweeter unit 66 disposed between the meter display unit 58 and the right midrange/woofer unit 64 for regenerating the high-notes. As shown in FIG. 2, the left speaker 61 includes the left super woofer unit 67 in the trunk box 39, and the right speaker 62 includes the right super woofer unit 68 in the trunk box 39.

The meter panel (instrument panel) 57 is a panel in which the left and right midrange/woofer units 63, 64 and the tweeter units 65, 66 can be arranged together with the meter display unit 58 and the navigation display unit 101.

The left and right midrange/woofer units 63, 64 are provided with nets (saran nets) for protecting the midrange/woofer units 63, 64.

For example, it is preferable to enable generated high-note sounds to sufficiently reach (be transmitted to) the operator (rider) during travel as well because the operator can hear the sounds with a realistic sensation.

Therefore, by configuring the speakers 61, 62 of the midrange/woofer units 63, 64 and the tweeter units 65, 66, the high-note sound can be easily regenerated. Consequently, the regenerated high-note sounds can reach (be transmitted to) the operator (rider) during travel as well. That is, the operator can hear the sound with a realistic sensation.

By arranging the tweeter unit 65 between the meter display unit 58 and the midrange/woofer unit 63 (by arranging the tweeter unit 66 between the meter display unit 58 and the midrange/woofer unit 64), the space around the meter display unit 58 can be efficiently used, or the spatial efficiency around the meter display unit 58 can be improved.

The left and right tweeter units 65, 66 are arranged so as to be oriented toward the operator. By arranging the left and right tweeter units 65, 66 towards the operator, the high-note sounds which have high directivity can be transmitted reliably to the operator.

Figure 6:
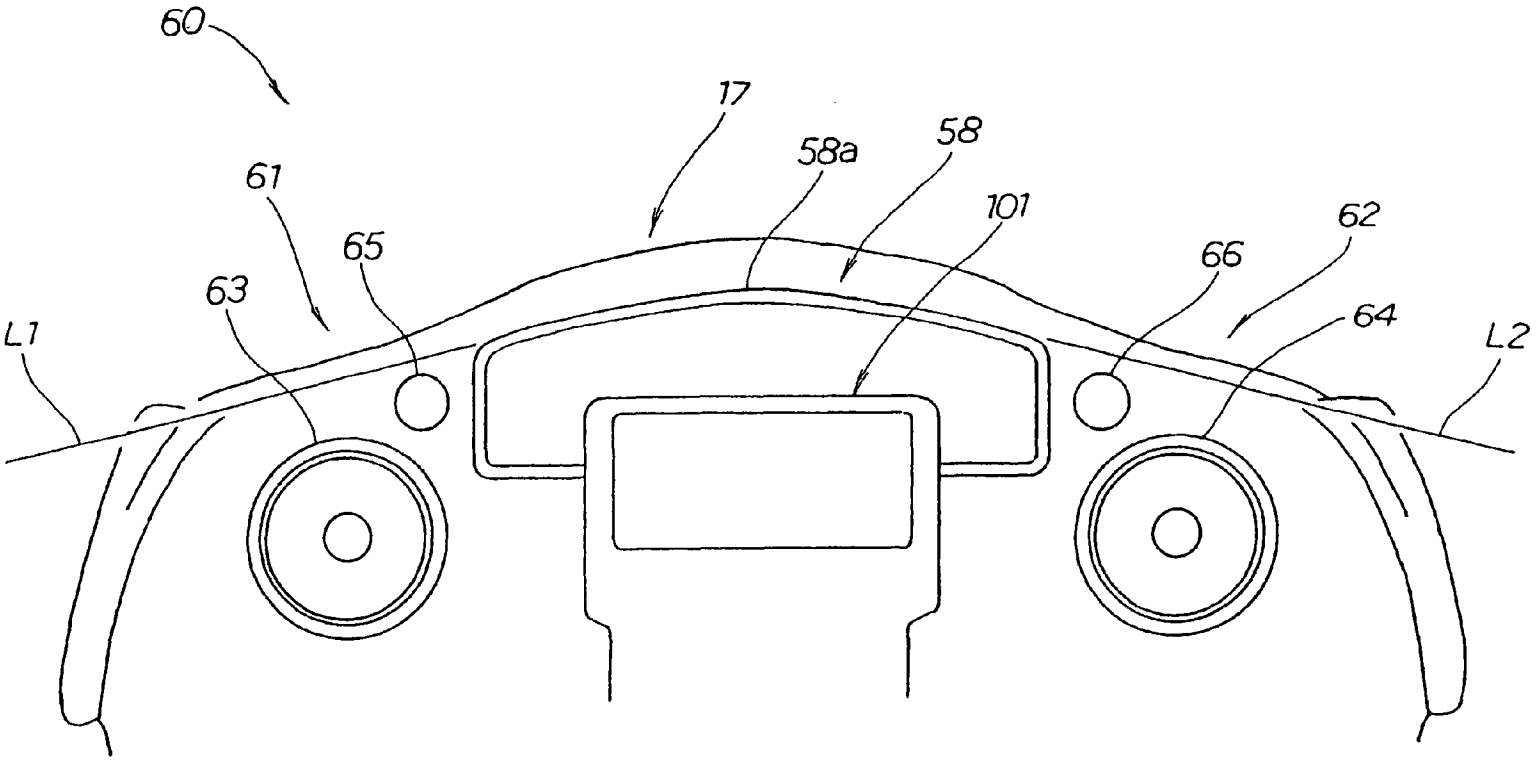
FIG. 6 is a layout drawing of the acoustic system for the motorcycle according to the present invention.

FIG. 6 is a layout drawing of the acoustic system for the motorcycle according to the present invention, showing a front view of the acoustic system 60 for the motorcycle.

In the acoustic system 60 for the motorcycle, the left and right tweeter units 65, 66 are arranged below extensions L1, L2, which are drawn so as to extend from an upper ridge line (upper outline) 58*a* of the outline of the meter display unit 58 in the lateral directions.

By arranging the left and right tweeter units 65, 66 below the extensions L1, L2, which are drawn so as to extend from the upper ridge line 58*a* of the outline of the meter display unit 58 in the lateral directions, the tweeter units 65, 66 can be arranged so as to maintain the visibility of the meter display unit 58. In comparison with the case wherein the left and right tweeter units 65, 66 are on a portion of the meter display unit 58, the outline of the meter display unit 58 can be prevented from increasing in size.

Figure 7:
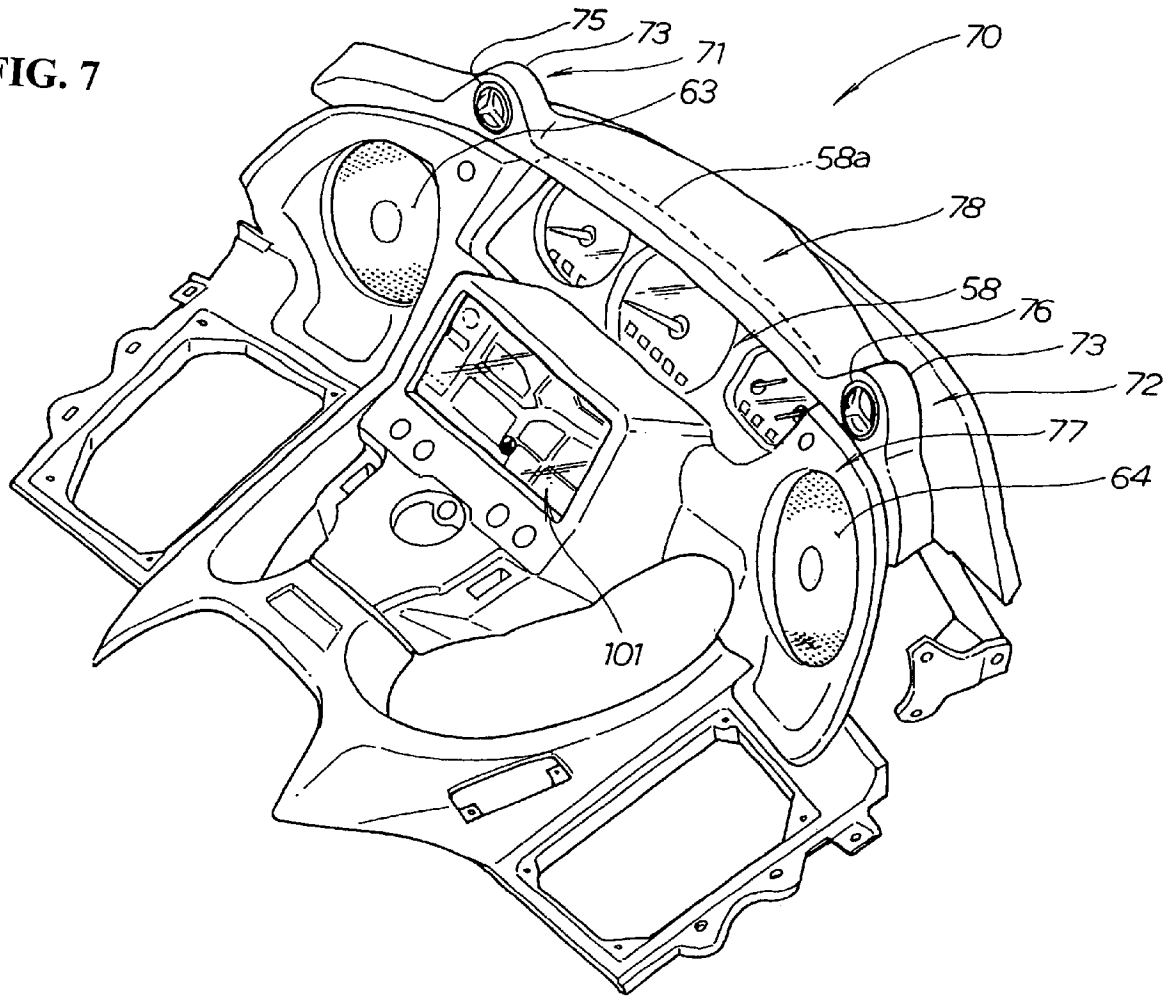
FIG. 7 is a perspective view of the acoustic system for the motorcycle according to another embodiment of the present invention.

FIG. 7 is a perspective view of the acoustic system for the motorcycle according to another embodiment of the present invention wherein the same parts as the acoustic system 60 for the motorcycle are represented by the same reference numerals and detailed description will be omitted.

In an acoustic system 70 for the motorcycle, the left and right midrange/woofer units (midrange/woofer speakers) 63, 64 are arranged on both sides of the meter display unit 58. A dash board 78 is provided on the upper portion of a meter panel (instrument panel) 77, with cover members (speaker boxes) 73, 73 being integrally provided on the left and right of the upper surface of the dash board 78. Left and right tweeter units (tweeter speakers) 75, 76 are disposed on the cover members 73, 73 via baffles 74, 74 (see FIG. 8) described later.

A left tweeter speaker assembly 71 includes the cover member 73, the baffle 74, and the tweeter unit 75, and a right tweeter speaker assembly 72 includes the cover member 73, the baffle 74, and the tweeter unit 76.

In the acoustic system 70 for the motorcycle, the left and right tweeter units 75, 76 are arranged on the meter display unit 58 so as to protrude upwardly of the vehicle body (from the upper ridge line 58*a* of the outline). As described in FIG. 9, the side surfaces and the bottoms of the left and right tweeter units 75, 76 are covered by the cover members 73, 73.

By arranging the left and right tweeter units 75, 76 on the meter display unit 58 so as to project upwardly of the vehicle body from the upper ridge line 58*a* and covering the side surfaces and the bottoms of the left and right tweeter units 75, 76 by the cover members 73, 73, the existence of the left and right tweeter units 75, 76 can be emphasized, thereby giving a high-quality look to the acoustic system 70.

Figure 8:
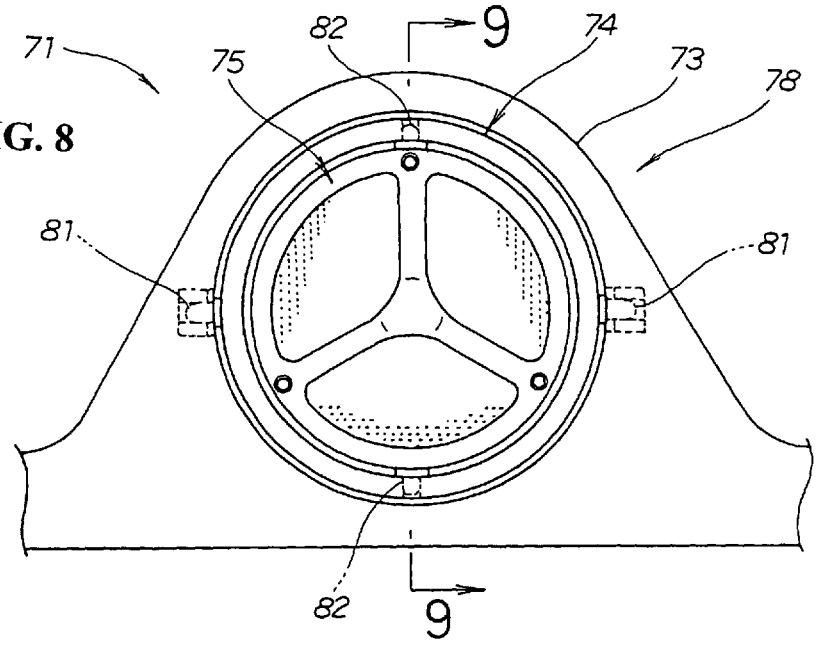
FIG. 8 is a front view of a tweeter speaker assembly of the acoustic system for the motorcycle according to another embodiment of the present invention.

FIG. 8 is a front view of the tweeter speaker assembly of the acoustic system for the motorcycle according to another embodiment of the present invention. The left tweeter speaker assembly 71 is configured in such a manner that the ring-shaped baffle (speaker supporting member) 74 is mounted to the cover member 73 so as to be capable of swinging in the vertical direction. In addition, the tweeter unit 75 is mounted to the baffle 74 so as to be capable of swinging in the lateral direction.

Figure 9:
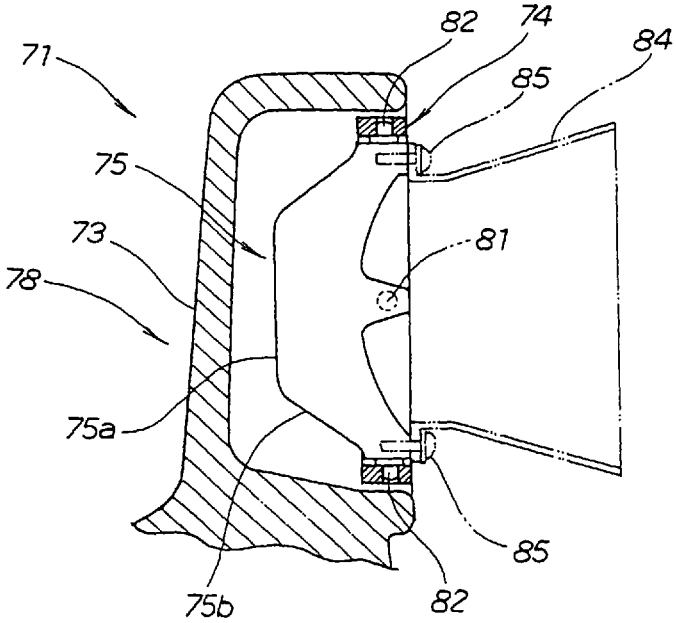
FIG. 9 is a cross-sectional view taken along the line 9-9 in FIG. 8.

The right tweeter speaker assembly 72 shown in FIG. 9 is an assembly having the same structure as the left tweeter speaker assembly 71.

The baffle 74 includes horizontal pins 81, 81 for being rotatably supported by the cover member 73.

The tweeter unit 75 includes vertical pins 82, 82 for being rotatably supported by the baffle 74, and screw holes 83 . . . ( . . . represents that there are a plurality of members, hereinafter) for mounting a duct 84 as shown in FIG. 9.

FIG. 9 is a cross-sectional view taken along the line 9-9 in FIG. 8. In addition, the tweeter speaker assembly 71 is configured to be capable of detachably attaching the duct (horn) 84 for preventing sound diffusion on the front surface of the tweeter unit 75. In FIG. 9, a bottom portion 75*a* of the tweeter unit 75 is provided together with a side surface 75*b* of the tweeter unit 75. Mounting screws 85 are provided for mounting the duct 84 to the tweeter unit 75.

The tweeter speaker assembly 71 is covered by the cover members 73, 73 on the side surface 75*a* and the bottom 75*b* of the tweeter unit 75.

Figure 10:
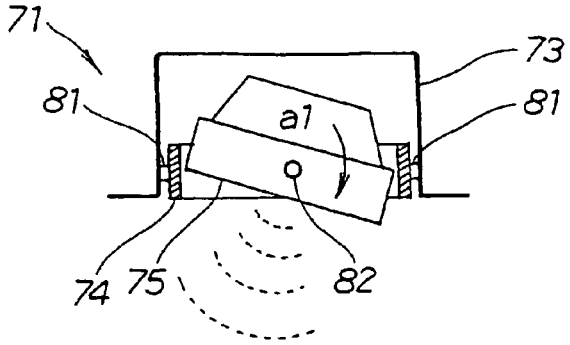
FIG. 10 is a drawing for explaining the operation of the swinging state of a tweeter unit of the acoustic system for the motorcycle according to another embodiment of the present invention.
Figure 10:
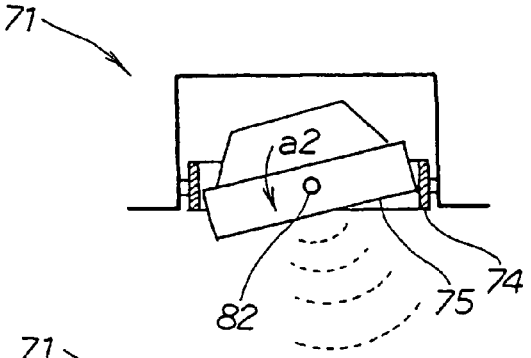
Figure 10:
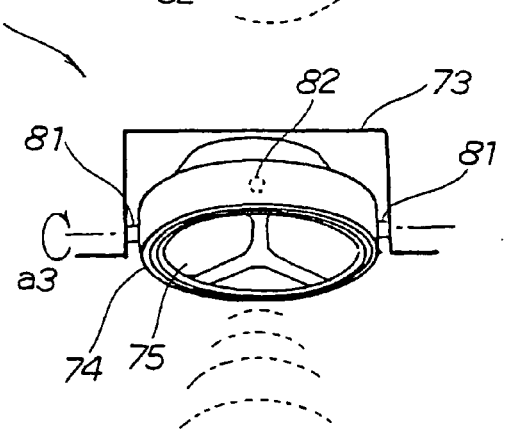
Figure 10:
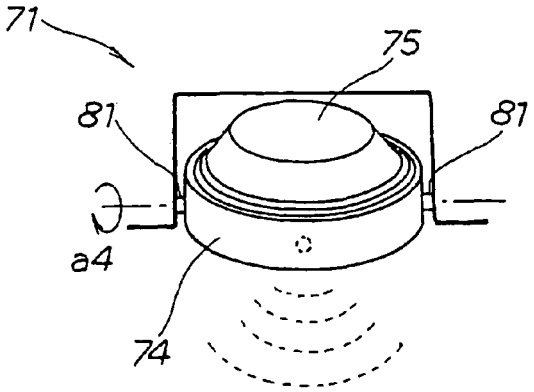

FIGS. 10(*a*)-(*d*) are drawings for explaining the operation of the swinging state of the tweeter unit of the acoustic system for the motorcycle according to another embodiment of the present invention.

In FIG. 10(*a*), by rotating the tweeter speaker 75 as shown by an arrow a1 about vertical shafts 82, 82 (one of the numerals 82 is not shown), the high-note sound can be directed toward the left.

In FIG. 10 (*b*), by rotating the high tweeter speaker 75 as shown by an arrow a2 about the vertical shafts 82, 82 (one of the numerals 82 is not shown), the high-note sound can be directed toward the right.

In FIG. 10 (*c*), by rotating the baffle 74 about the horizontal shafts 81, 81 as indicated by an arrow a3, the high-note sound can be directed upwardly.

In FIG. 10 (*d*), by rotating the baffle 74 about the horizontal shafts 81, 81 as indicated by an arrow a4, the high-note sound can be directed downwardly.

In other words, since the ring-shaped baffle (speaker supporting member) 74 which is capable of swinging in the vertical direction is mounted to the cover member 73, and the tweeter unit 75 is mounted to the baffle 74 so as to be capable of swinging in the lateral direction. Thus, the direction of the tweeter unit 75 can be changed arbitrary in accordance with the posture of the operator. Consequently, the tweeter unit 75 can be set to the best direction.

Figure 11A:
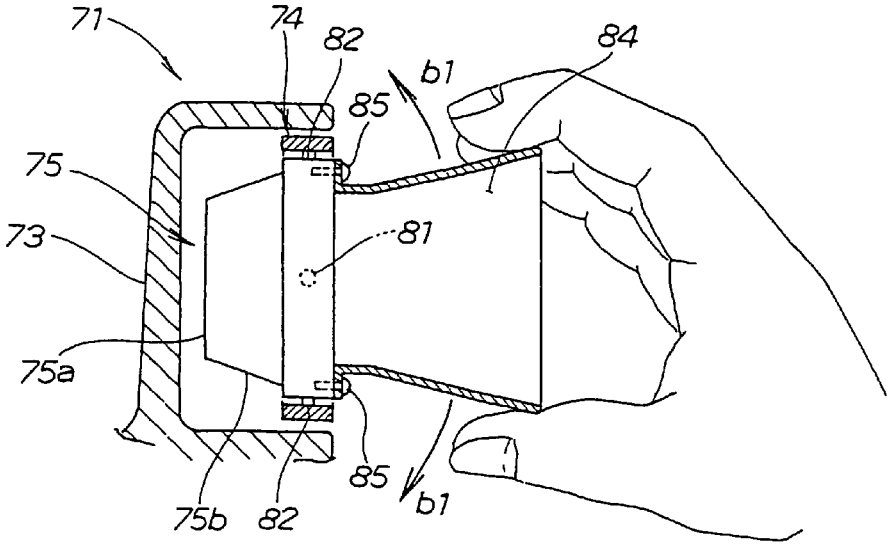
FIG. 11 is a drawing for explaining the operation of a duct of the tweeter unit of the acoustic system for the motorcycle according to another embodiment of the present invention.
Figure 11B:
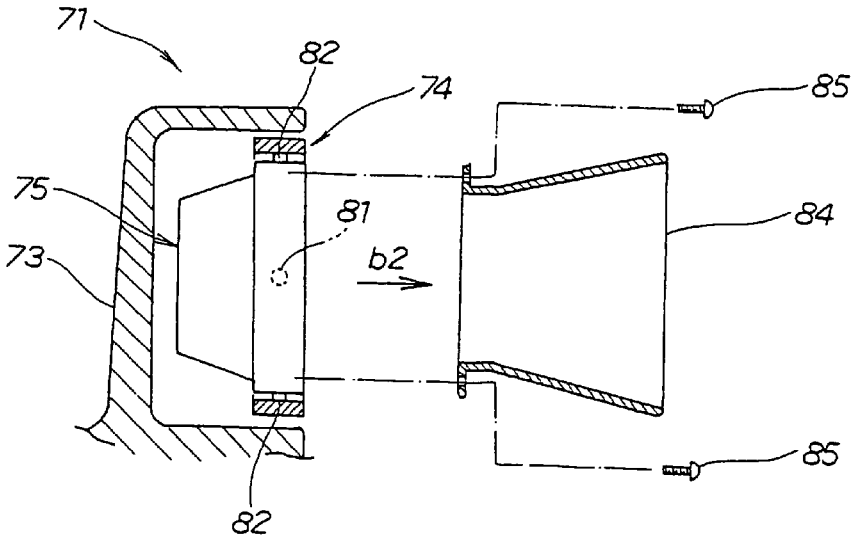

FIGS. 11(*a*) and 11(*b*) are drawings for explaining the operation of the tweeter unit of the acoustic system for the motorcycle according to another embodiment of the present invention.

FIG. 11 (*a*) shows the tweeter speaker assembly 71 in a state wherein the duct for preventing sound diffusion is detachably attached to the front surface of the tweeter unit 75.

The tweeter speaker assembly 71 can emphasize the high-note sound by attaching the duct (hone) 84 detachably for preventing sound diffusion on the front surface of the tweeter unit 75. In addition, the tweeter unit 75 can be moved to the directions as indicated by the arrows b1, b1 and the tweeter unit 75 can be set to a desired direction by the operator by holding the duct 84.

In other word, the direction of the tweeter unit 75 can be changed easily.

In FIG. 11(*b*), by loosening the mounting screws 85 . . . , the duct 84 can be removed as indicated by an arrow b2. In other words, the mode of the tweeter unit 75 (with the duct 84 or without the duct 84) can be selected. Thus, preference property of the acoustic system 70 can be increased.

The motorcycle navigation system 100 will be described below.

Figure 12:
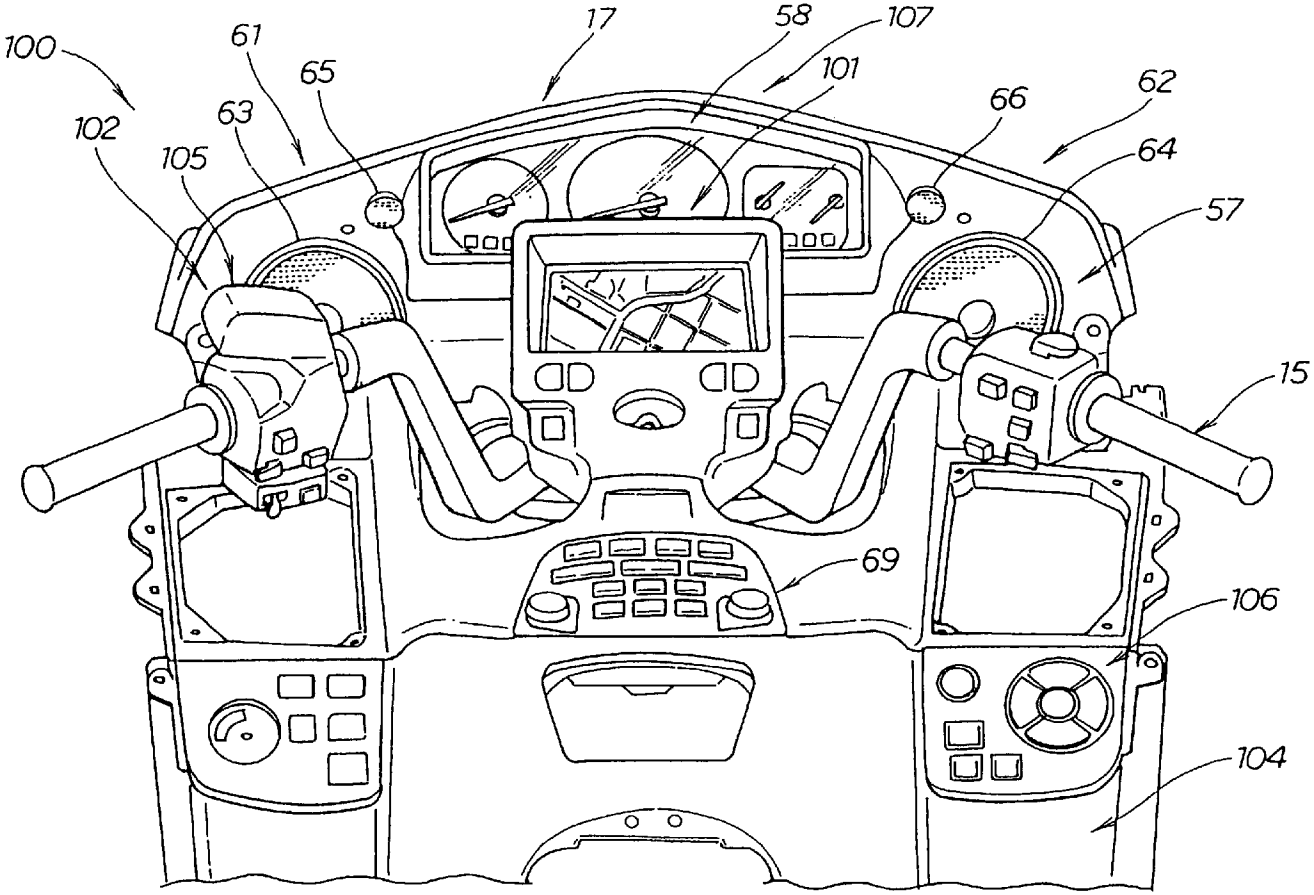
FIG. 12 is a perspective view of the motorcycle navigation system according to the present invention.

FIG. 12 is a perspective view of the motorcycle navigation system according to the present invention. The motorcycle navigation system 100 includes the navigation display unit 101 disposed behind the meter display unit 58. The operating element 102 is divided into sections and is arranged around the steering handle 15 and the upper panel 104. The control unit 103 (see FIG. 2) is stored in the trunk box 39.

The operating element 102 includes a main control box 105 and a sub-control box 106, and the main control box 105 is mounted to the left part of the steering handle 15 so that the operator can operate during operation, and the sub-control box 106 is mounted to the upper panel 104 so that the operator can operate when the motorcycle is stopped.

Figure 13:
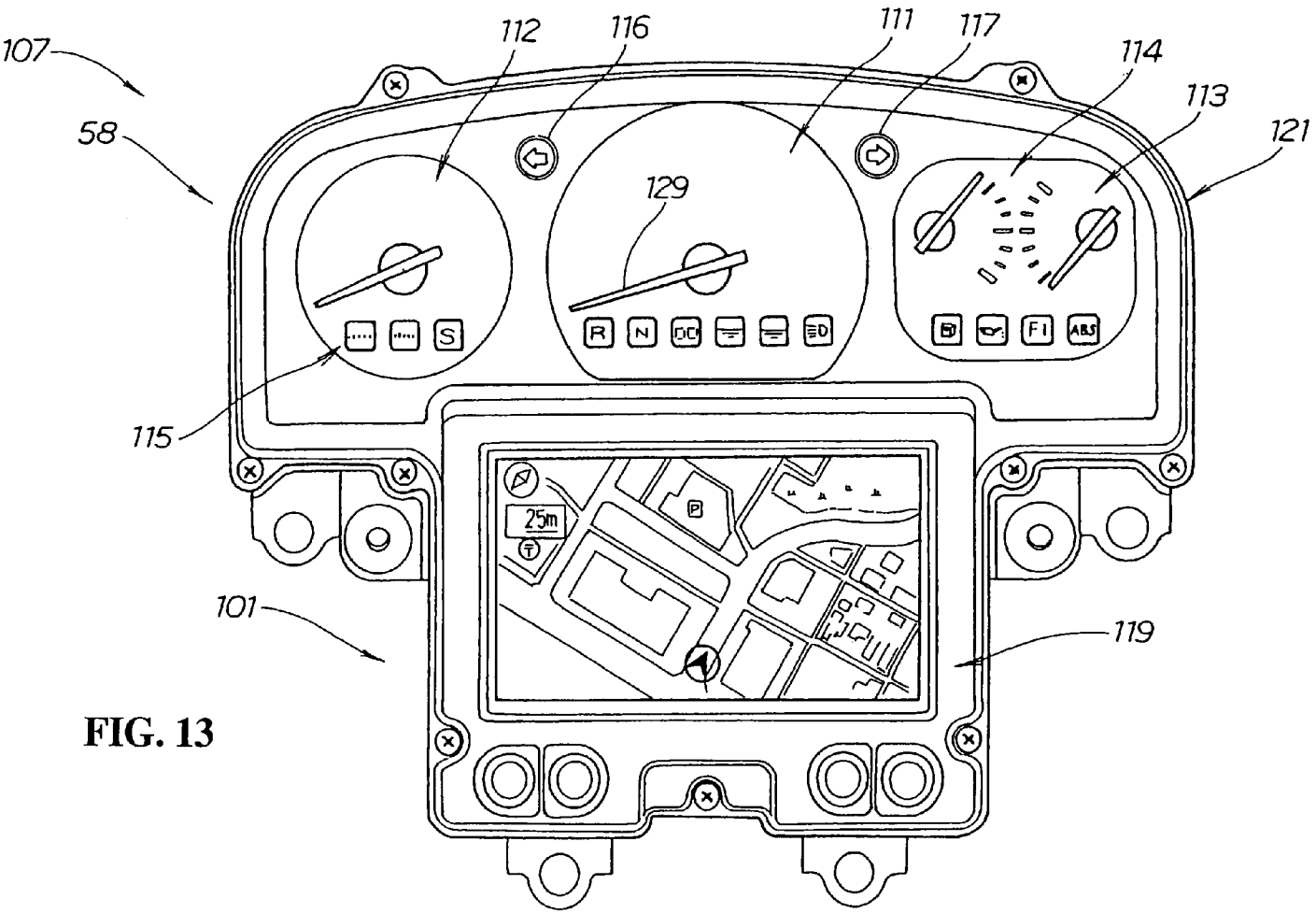
FIG. 13 is a front view showing a meter display unit and a navigation display unit of the motorcycle navigation system according to the present invention.

FIG. 13 is a front view showing the meter display unit of the motorcycle navigation system and the navigation display unit according to the present invention. The meter display unit (vehicle meter) 58 is a portion displaying a speed meter 111 for displaying the vehicle speed, a tachometer 112 for displaying the number of engine revolution, a coolant temperature meter 113 for displaying the temperature of cooling water, a fuel meter 114 for displaying the residual quantity of fuel, warning marks 115 for giving a warning or calling the operator's attention and left and right winker marks 116, 117 for showing the state of the winker's illumination. The internal structure thereof will be described in conjunction with FIG. 15.

The navigation display unit 101 displays not only navigation information such as the destination or the current vehicle position, but also warning information for giving a warning or calling the operator's attention, or displays audio information of the component 69 (see FIG. 12). The internal structure will be described in conjunction with FIG. 15.

Figure 14:
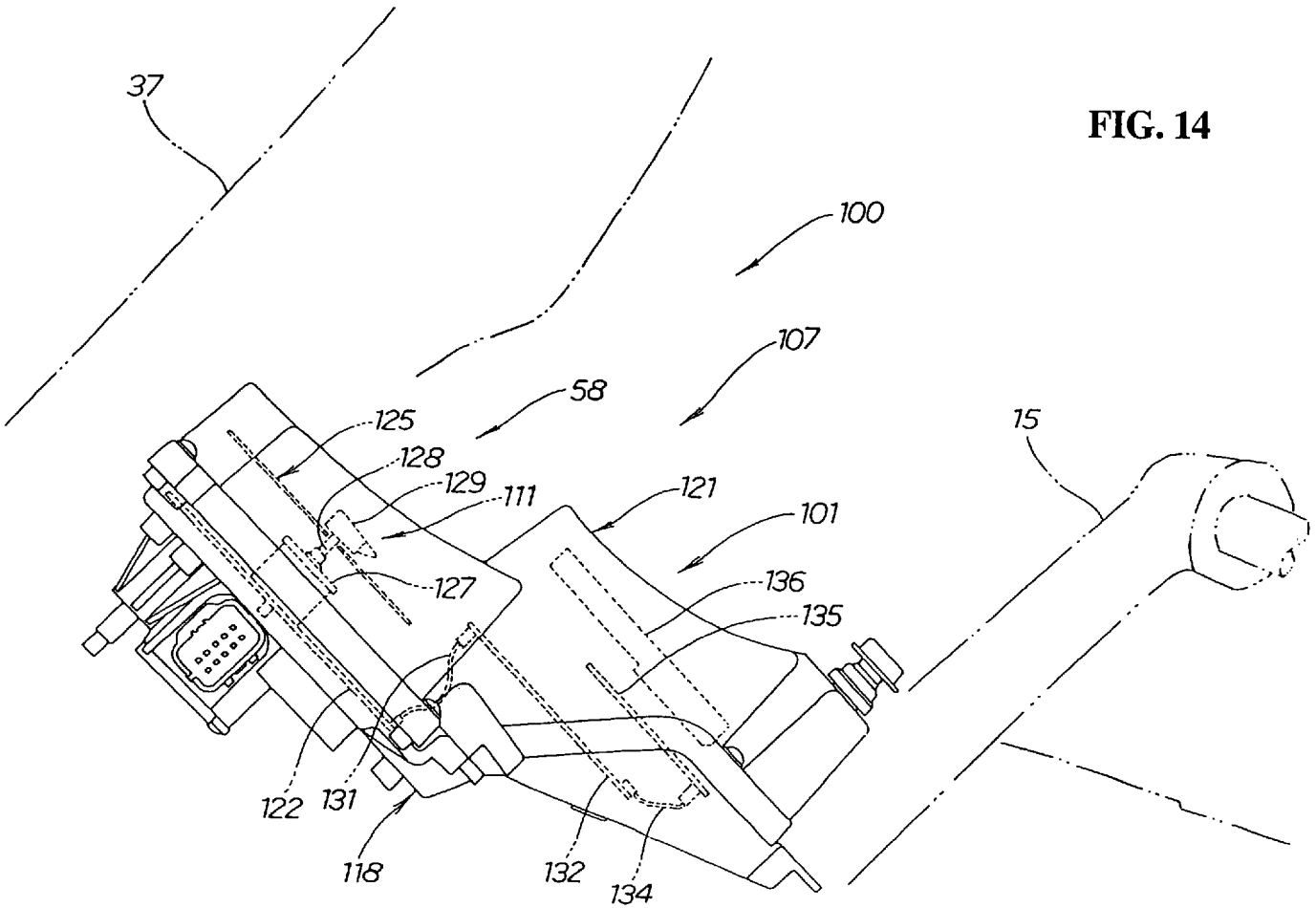
FIG. 14 is a side view of the meter display unit and the navigation display unit of the motorcycle navigation system according to the present invention.

FIG. 14 is a side view of the meter display unit of the motorcycle navigation system and the navigation display unit according to the present invention, showing the arrangement relation of the meter display unit and the navigation display unit.

The motorcycle navigation system 100 in the motorcycle 10 (see FIG. 1) includes the meter display unit 58 for displaying drive information such as a vehicle speed or a travel distance and the navigation display unit 101 for displaying the destination or the current vehicle position. A transparent panel 121 is provided for covering both the meter display unit 58 and the navigation display unit 101 so as to be capable of seeing therethrough. The navigation display unit 101 is disposed behind the meter display unit 58 so as to project with respect to the meter display unit 58.

In other words, by disposing the navigation display unit 101 behind the meter display unit 58 and being disposed so as to project with respect to the meter display unit 58, for example, the operator can easily hear the sound of the speakers 61, 62 (see FIG. 5) and can easily view the meter display unit.

By covering the meter display unit 58 and the navigation display unit 101 together with the transparent panel (panel) 121 so as to be capable of seeing therethrough, the meter display unit 58 and the navigation display unit 101 can both be protected from water drops. Consequently, the sealing property of the meter display unit 58 or the navigation display unit 101 can be improved.

Figure 15:
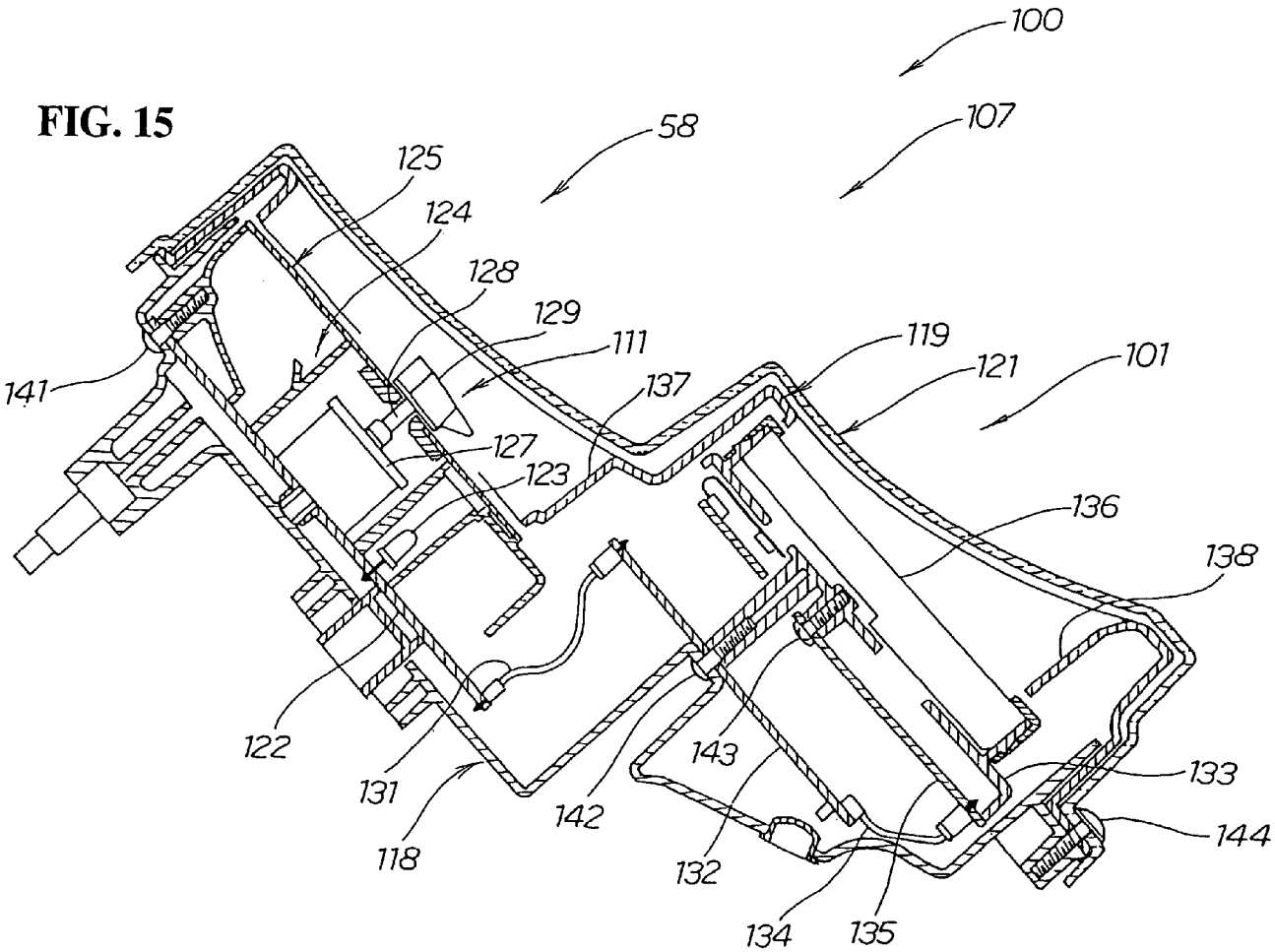
FIG. 15 is a cross-sectional side view of the meter display unit and the navigation display unit of the motorcycle navigation system according to the present invention.

FIG. 15 is a cross-sectional side view of the meter display unit and the navigation display unit of the motorcycle navigation system according to the present invention, showing the internal structure of the meter display unit 58 and the navigation display unit 101.

A display unit 107 includes the meter display unit (vehicle meter) 58, the navigation display unit 101 described above, a housing 118 for integrally accommodating the meter display unit 58 and the navigation display unit 101 and a frame body 119 for distinguishing the meter display unit 58 and the navigation display unit 101 in appearance. A transparent panel 121 is provided for covering the housing 118 so that the meter display unit 58 and the navigation display unit 101 and the frame body 119 are capable of being seen through the transparent panel 121.

The meter display unit (vehicle meter) 58 includes a meter control substrate 122 to be mounted to the housing 118, the speed meter 111 to be mounted on the meter control substrate 122, the tachometer 112 (see FIG. 13), the coolant temperature meter 113, the fuel meter 114, LEDs (Light Emitting Diode) 123 . . . (only one is shown) mounted on the meter control substrate 122 for illuminating the warning marks 115 (see FIG. 13) and the left and right winker marks 116, 117. A partitioning holder 124 is provided to be mounted on the meter control substrate 122 for partitioning the speed meter 111, the tachometer 112, the coolant temperature meter 113, the fuel meter 114, and the LED 123 . . . . A character display plate 125 is provided which indicates the characters and the warning marks 115 of the speed meter 111 mounted on the partitioning holder 124.

The speed meter 111 includes a step motor 127 mounted on the meter control substrate 122, and an indicating needle 129 to be mounted to a shaft 128 of the step motor 127 and placed on the character display plate 125 so as to be capable of rotating.

The tachometer 112, the coolant temperature meter 113, and fuel meter 114 shown in FIG. 13 are components which are substantially the same as those of the speed meter 111.

The navigation display unit 101 includes a navigation control substrate 132 to be mounted to the housing 118 and connected to the meter control substrate 122 via a first harness 131, a liquid crystal holder 133 supported on the housing 118 via the navigation control substrate 132, a liquid crystal substrate 135 connected to the navigation control substrate 132 via a second harness 134 and supported by the liquid crystal holder 133, and a liquid crystal panel 136 connected to the liquid crystal substrate 135 and placed on the liquid crystal holder 133.

The frame body 119 includes a meter opening 137 for exposing the meter display unit 58, and a liquid crystal opening 138 for exposing the navigation display unit 101.

In FIG. 15, a mounting screw 141 is provided for mounting the meter control substrate 122 to the housing 118. A mounting screw 142 is provided for tightening the navigation control substrate 132 and the liquid crystal holder 133 together to the housing 118. A mounting screw 143 is provided for mounting the liquid crystal substrate 135 to the liquid crystal holder 133. In addition, a mounting screw 144 is provided for mounting the transparent panel 121 to the housing 118.

In other words, the motorcycle navigation system 100 includes the meter display unit 58 and the navigation display unit 101 integrally mounted in the transparent panel (panel) 121. The frame body 119 is provided for displaying the navigation display unit 101 independently from the meter display unit 58 in the transparent panel (panel) 121.

By providing the meter display unit 58 and the navigation display unit 101 integrally in the transparent panel 121, and providing the frame body 119 for displaying the navigation display unit 101 independently from the meter display unit 58 in the appearance on the meter panel 57, for example, the internal structure of the electrical circuits of the meter display unit 58 and the navigation display unit 101 can be gathered up. Consequently, the cost of the meter display unit 58 and the navigation display unit 101 can be achieved.

Figure 16:
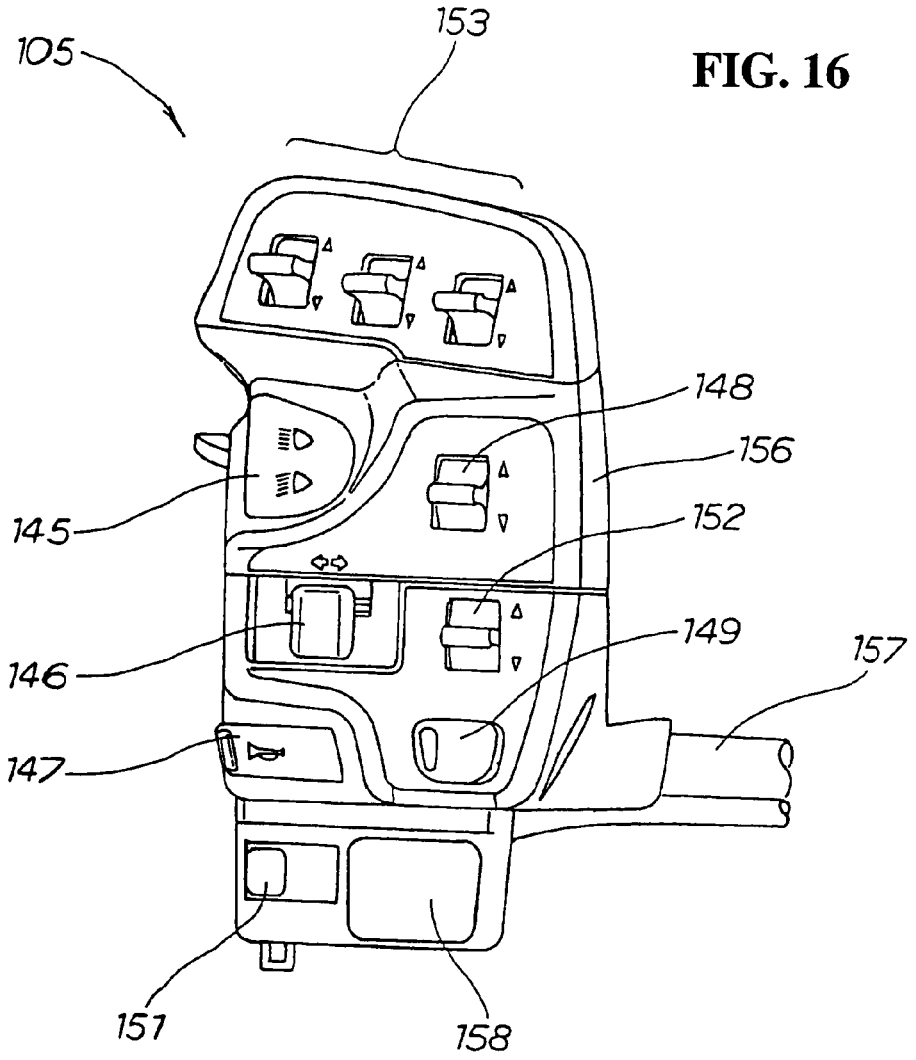
FIG. 16 is a front view of a main control box of the motorcycle navigation system according to the present invention.

FIG. 16 is a front view of the main control box of the motorcycle navigation system according to the present invention. The main control box 105 is an operating element having control buttons or control levers to be operated during operation of the vehicle that are arranged thereon. The main control box 105 includes a light control button 145 for illuminating the head lights 18, 18 (see FIG. 3) or the tail lamps 44, 44 (see FIG. 4), a winker sliding tab 146 for operating the left and right front winkers 36, 36 (see FIG. 3), and the left and right rear winkers 42, 42 (see FIG. 4), a horn switch button 147 for sounding the horn (not shown), a volume lever 148 for adjusting the volume level of the component 69 (see FIG. 12) or the navigation system 100, a mute button 149 for temporarily reducing the volume level of the component 69 or the navigation system 100 downwardly, a map guide button 151 used when using a voice guide function of the navigation system 100, a tuning/disk button 152 for selecting the broadcasting station or the track number of the disk such as a CD on the component 69, and an amateur radio lever 153 for operating the amateur radio (not shown) arranged therein.

The voice guide function is, for example, a function for audibly announcing that the motorcycle is approaching a railroad crossing or approaching the destination.

In FIG. 16, a main control box body 156 is provided together with a main control cable 157 extending from the control box body 156 and a print display unit 158 of the map guide button 151.

Figure 17:
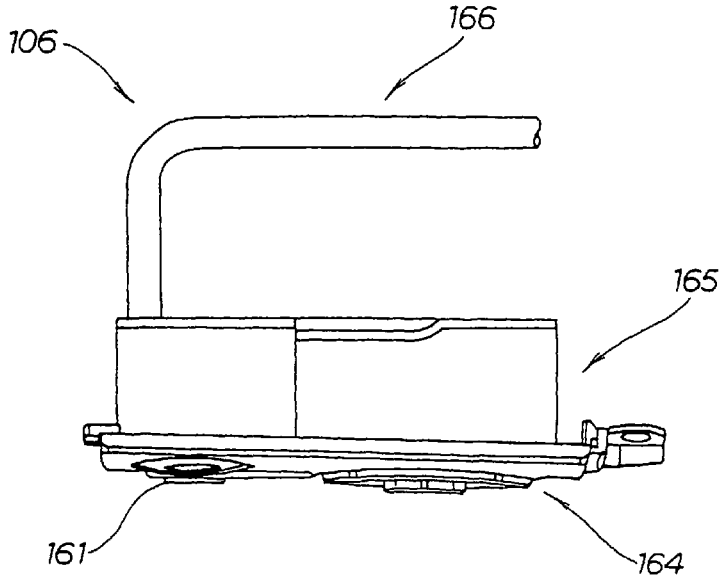
FIG. 17 is a front view of a sub-control box of the motorcycle navigation system according to the present invention.
Figure 18:
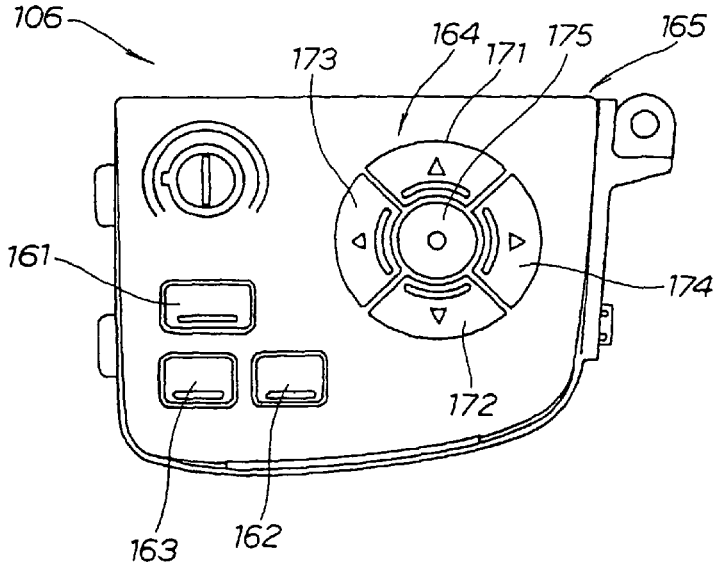
FIG. 18 is a plan view of the sub-control box of the motorcycle navigation system according to the present invention.

FIG. 17 is a front view of the sub-control box of the motorcycle navigation system according to the present invention. FIG. 18 is a plan view of the sub-control box of the motorcycle navigation system according to the present invention.

The sub-control box 106 is an operating part in which buttons are arranged when the motorcycle is stopped. FIG. 18 illustrates a menu button 161 for displaying a route guide or various setting details, a cancel button 162 for canceling the selected item, a map button 163 for displaying a highway map or a town map, a selecting and deciding button 164 for selecting and deciding a menu or map displayed by the menu button 161 or the map button 163, a sub-control box body 165 for arranging these buttons 161-164, and a sub-control cable 166 shown in FIG. 17 extending from the sub-control box body 165.

The selecting and deciding button 164 includes selecting buttons 171-174 for selecting the menu or the map, and a deciding button 175 for deciding the selected menu or map.

Figure 19:
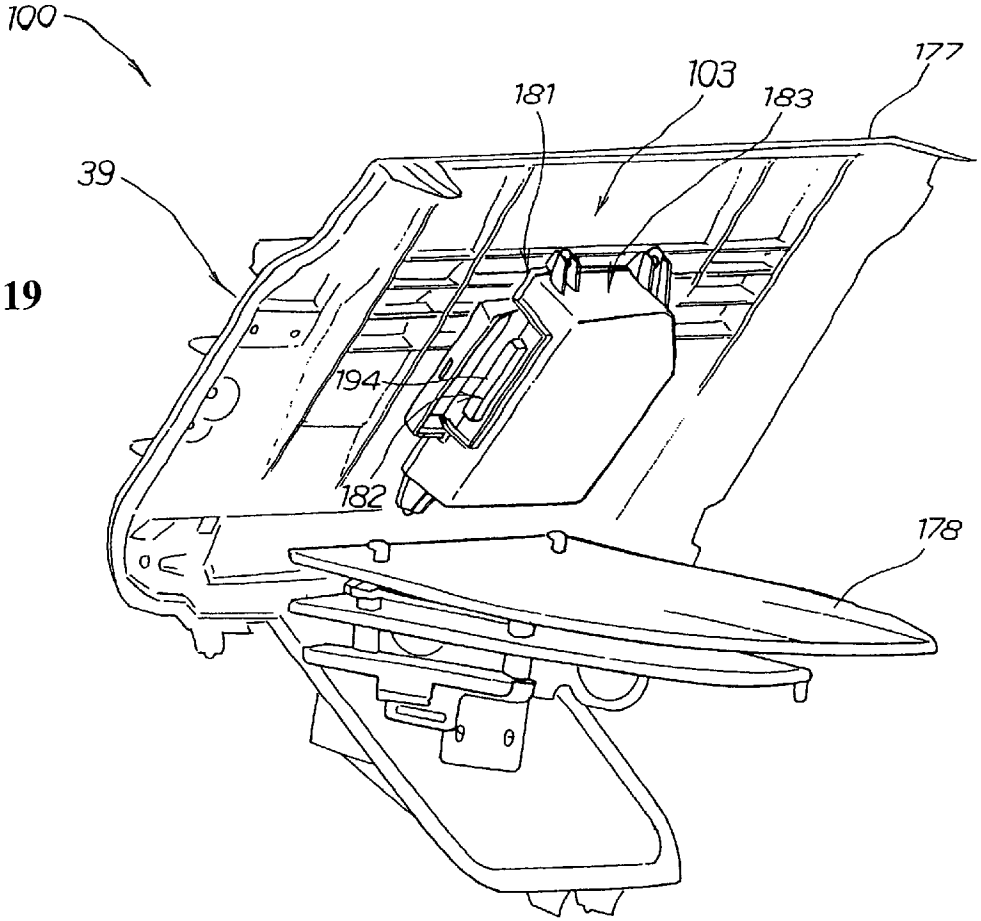
FIG. 19 is a perspective view showing a mounting state of a control unit of the motorcycle navigation system according to the present invention.

FIG. 19 is a perspective view showing a mounting state of the control unit of the motorcycle navigation system according to the present invention wherein a front wall 177 as a wall surface of the trunk box 39 is provided together with a bottom plate 178 of the trunk box 39. In the motorcycle navigation system 100 including the navigation display unit 101 (see FIG. 12) for displaying navigational information such as the destination or the current vehicle position, the control unit (controller) 103 for driving the navigation display unit 101, and the operating element 102 (see FIG. 12), to be connected to the control unit 103, is disposed in the trunk box 39 provided in the rear of the vehicle body.

By arranging the control unit 103 in the trunk box 39 provided in the rear of the vehicle body, a sufficient space for arranging the meter display unit 58 (see FIG. 12) and the navigation display unit 101 is provided. Consequently, the navigation system 100 can be easily mounted to the motorcycle 10 (see FIG. 1).

It can also be said that the motorcycle navigation system 100 is a system in which the control unit 103 is mounted along the front wall (wall surface) 177 of the trunk box 39. By mounting the control unit 103 along the front wall 177 of the trunk box 39, the control unit 103 can be stored in the trunk box 39 without impairing the usability of the trunk box 39. Consequently, the control unit 103 can be stored while securing convenience of the trunk box 39.

Figure 20:
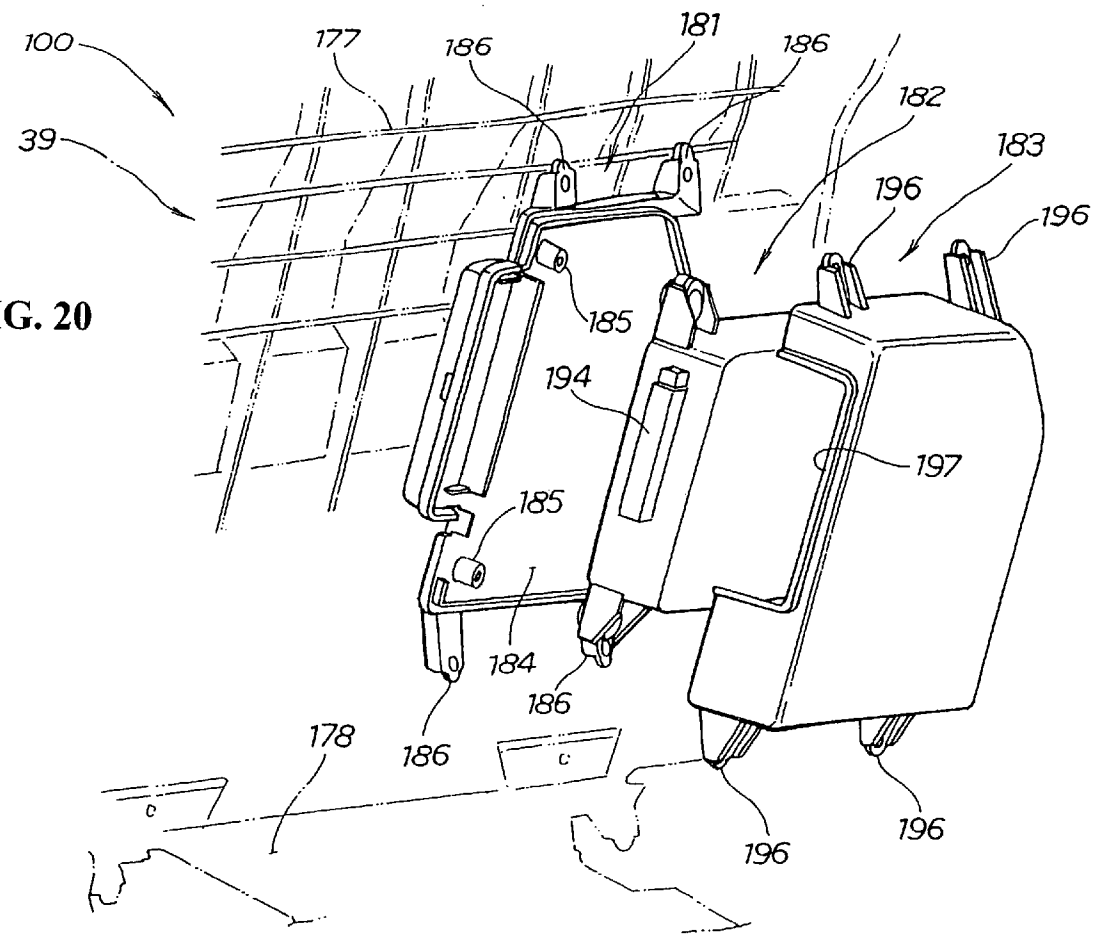
FIG. 20 is an exploded perspective view of the control unit of the motorcycle navigation system according to the present invention.

FIG. 20 is an exploded perspective view of the control unit of the motorcycle navigation system according to the present invention. The control unit 103 includes a base member 181 to be abutted against the front wall (wall surface) 177, a unit body 182 for positioning the control unit 103 on the base member 181, and a cover member 183 for covering the unit body 182.

The control unit 103 is fixed by sandwiching the unit body 182 between the base member 181 and the cover member 183 by securing the base member 181 and the cover member 183 to the front wall 177 together.

By constituting the control unit 103 of the base member 181 to be abutted against the front wall (wall surface) 177, the unit body 182 for positioning the control unit 103 on the base member 181, and the cover member 183 for covering the unit body 182, the control unit 103 can be stored while maintaining the article storing function of the trunk box 39.

By securing the base member 181 and the cover member 183 together to the front wall (wall surface) 177, for example, when it is necessary to provide vibration control means on the unit body 182, it is achieved simply by placing a cushion between the base member 181 and the unit body 182, and placing a cushion between the unit body 182 and the cover member 183. Thus, countermeasures in case of an emergency such as a vibration control means may easily be achieved.

The base member 181, the unit body 182, and the cover member 183 will be described below.

Figure 21:
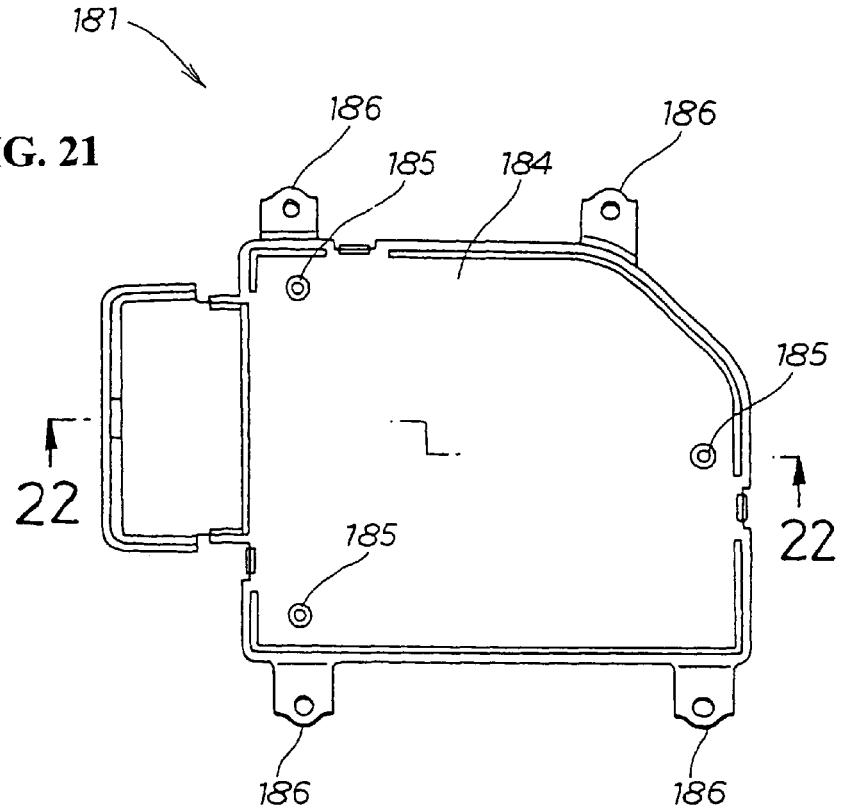
FIG. 21 is a plan view of a base member of the control unit of the motorcycle navigation system according to the present invention.
Figure 22:
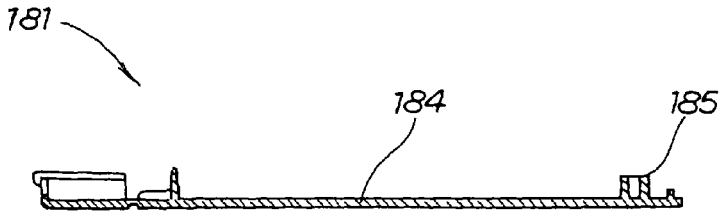
FIG. 22 is a cross-sectional view taken along the line 22-22 in FIG. 21.

FIG. 21 is a plan view of the base member of the control unit in the motorcycle navigation system according to the present invention, and FIG. 22 is a cross-sectional view taken along the line 22-22 in FIG. 21.

The base member 181 is a member including a placing portion 184 for placing the unit body 182 (see FIG. 20), positioning bosses 185 . . . being formed on the placing portion 184 for positioning the unit body 182, and mounting portions 186 . . . to be secured with the cover member 183 (see FIG. 20) to the front wall 177.

Figure 23:
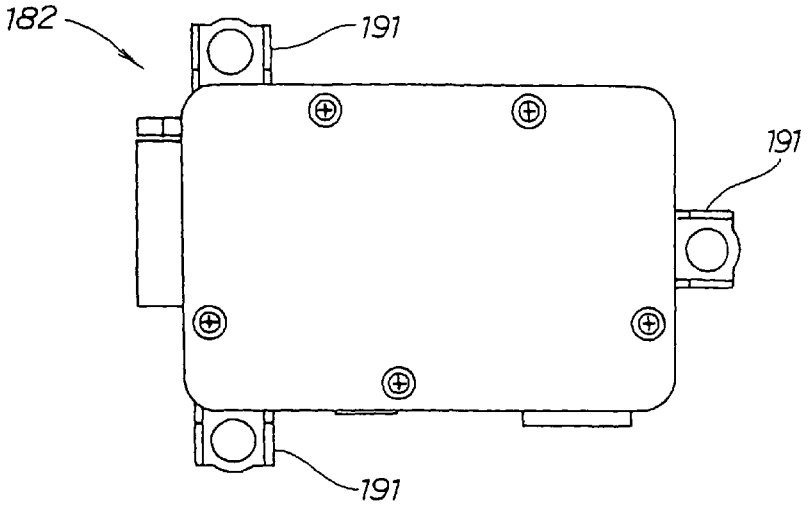
FIG. 23 is a plan view of a unit body of the control unit of the motorcycle navigation system according to the present invention.
Figure 24:
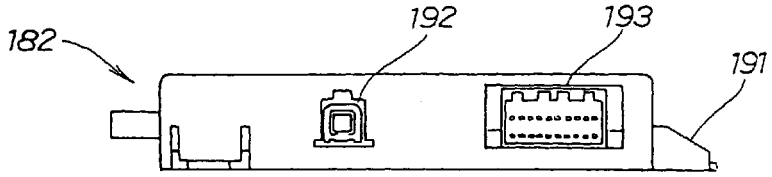
FIG. 24 is a front view of the unit body of the control unit of the motorcycle navigation system according to the present invention.
Figure 25:
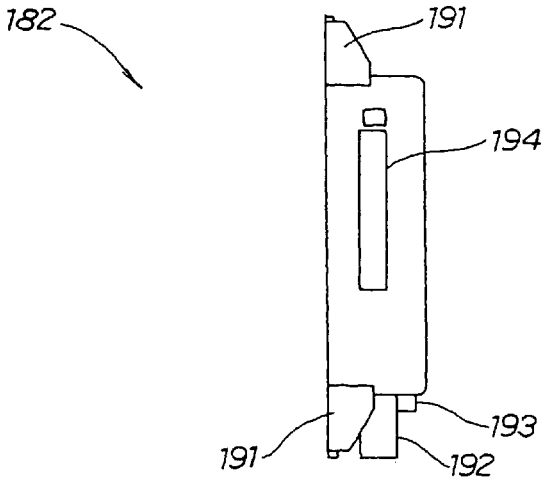
FIG. 25 is a side view of the unit body of the control unit of the motorcycle navigation system according to the present invention.

FIG. 23 is a plan view of the unit body of the control unit in the motorcycle navigation system according to the present invention. FIG. 24 is a front view of the unit body of the control unit in the motorcycle navigation system according to the present invention. FIG. 25 is a side view of the unit body of the control unit in the motorcycle navigation system according to the present invention.

The unit body 182 is a portion accommodating a control function, and includes fitting, portions 191 . . . to be fitted into the positioning bosses 185 . . . of the base member 181 (see FIG. 21), a connector 192 for connecting part of the main control cable 157 (see FIG. 16), a connector 193 for connecting the sub-control cable 166 (see FIG. 17) as shown in FIG. 25, and a connector 194 for connecting a cable (not shown) for connecting to the navigation display unit 101 (see FIG. 12).

Figure 26:
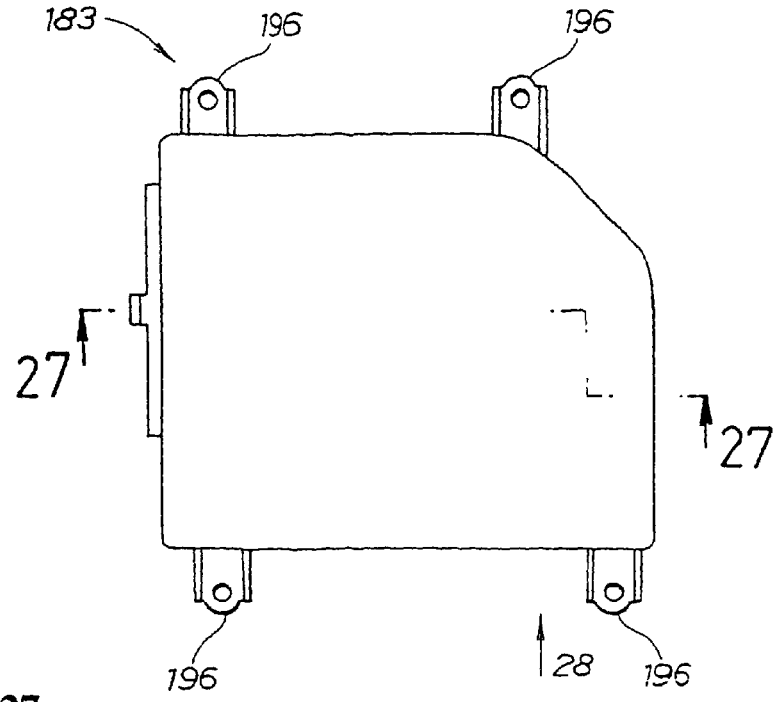
FIG. 26 is a plan view of a cover member of the control unit of the motorcycle navigation system according to the present invention.
Figure 27:
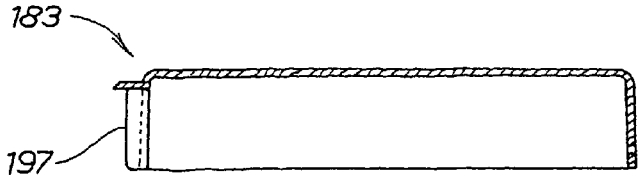
FIG. 27 is a cross-sectional view taken along the line 27-27 in FIG. 26.
Figure 28:
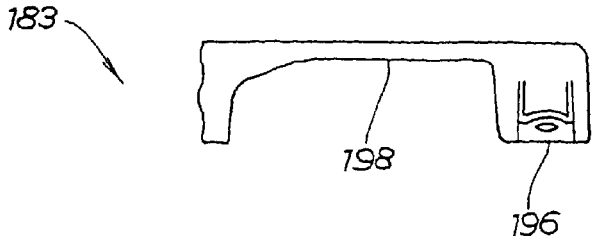
FIG. 28 is a drawing viewed in the direction of an arrow 28 in FIG. 26.

FIG. 26 is a plan view of the cover member of the control unit for the motorcycle navigation system according to the present invention. FIG. 27 is a cross-sectional view taken along the line 27-27 in FIG. 26. FIG. 28 is a drawing viewed in the direction of an arrow 28 in FIG. 26.

The cover member 183 is a cover including mounting portions 196 . . . for mounting the cover member 183 together with the base member 181 to the front wall 177, an opening 197 for exposing the connector 194 (see FIG. 25) of the unit body 182 as shown in FIG. 27, and a notched portion 198 as shown in FIG. 28 for exposing the connectors 192, 193 of the unit body 182 (see FIG. 24).

In the acoustic system 60 for the motorcycle according to the present invention, the two super woofer units (super woofer speakers) 67, 68 are arranged in the trunk box as shown in FIG. 2. However, the present invention is not limited thereto, and it is also possible to arrange one single super woofer unit (super woofer speaker) at the center of the vehicle body. The super woofer unit may also be embedded in the seat back of the vehicle seat.

As shown in FIG. 2, in the acoustic system 60 for the motorcycle according to the present invention, the left and right tweeter units 65, 66 and the left and right midrange/woofer units 63, 64 are disposed in the meter panel (instrument panel) 57, and the left and right super woofer units 67, 68 are arranged in the trunk box 39. However, the present invention is not limited thereto, and it is also possible to arrange a tweeter unit (tweeter) and a midrange unit (squaker) in the meter panel (instrument panel), arrange the woofer unit (woofer) in the trunk box.

As shown in FIG. 5, in the acoustic system 60 for the motorcycle according to the present invention, the tweeter units 65, 66 are fixed to the meter panel (instrument panel) 57 so as to be directed to the operator, it is not limited thereto. As shown in FIG. 8, the tweeter units 65, 66 may be mounted so as to be capable of swinging in the lateral and vertical directions.

As shown in FIG. 8, in the motorcycle acoustic system 70 (see FIG. 7) according to another embodiment of the present invention, the ring-shaped baffle (speaker supporting member) 74 is mounted to the cover member 73 so as to be capable of swinging in the vertical direction, and the tweeter unit 75 is mounted to the baffle 74 so as to be capable of swinging in the lateral direction. However, the present invention is not limited thereto, and the tweeter unit 75 may be configured in such a manner that the ring-shaped baffle (speaker supporting member) is attached to the cover member so as to be capable of swinging in the lateral direction, and the tweeter unit 75 is mounted to the baffle so as to be capable of swinging in the vertical direction.

As shown in FIG. 19, the motorcycle navigation system 100 according to the present invention is mounted to the front wall 177 of the trunk box 39. However, the present invention is not limited thereto, and may be mounted to a wall surface other than the front wall (left and right wall or the rear wall).

The motorcycle acoustic system according to the present invention is preferably employed in a large-sized motorcycle.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A motorcycle comprising:

a meter display unit in front of a rider and displaying drive information;

left and right speaker systems, the left and right speaker systems are disposed on either side of the meter display unit;

a navigational system projecting from a front of the meter display unit, the navigational system having a display unit between the left and right speakers and being behind the meter display unit;

wherein each of the left and right speaker systems comprises a mid-range or woofer unit and a tweeter unit, wherein the meter display unit is disposed between the left and right tweeter units, the navigational system display unit is disposed between the left and right midrange or woofer units, and the left and right tweeter units are disposed above and closer together than the left and right midrange or woofer units, wherein each tweeter unit includes a housing that is provided separate and apart from the corresponding midrange or woofer unit, and wherein the motorcycle further includes:

a baffle surrounding each tweeter, each tweeter mounted in a panel, a first pin extending between the tweeter and baffle, allowing rotation about the first pin, and a second pin extending between the baffle and panel, allowing rotation about the second pin.

2. The motorcycle according to claim 1, wherein the left and right tweeter units are arranged below extensions, which are drawn so as to extend in lateral directions from an upper ridge line of an outline of the meter display unit.

3. The motorcycle according to claim 1, wherein an audio device is connected to the left and right midrange or woofer units and the left and right tweeter units.

4. The motorcycle according to claim 1, and further including a super woofer unit for regenerating a frequency range lower than the left and right midrange or woofer units, said super woofer unit being disposed in a trunk box.

5. The motorcycle according to claim 4, and further including a component from the group consisting of a tuner, a compact disc deck, a mini disc deck, a cassette deck and an amplifier, said component being disposed in the trunk box.

6. The motorcycle acoustic system according to claim 1, further comprising:

a wind screen, the tweeter placed under the wind screen.

7. The motorcycle according to claim 1, wherein the housings of the left and right tweeter units extend beyond a topmost point of the meter display unit.

8. An acoustic system for use with a motorcycle comprising:

a left speaker including a left midrange or woofer unit disposed on a left side of a meter display unit for regenerating midrange or low note sound and a left tweeter unit disposed between the meter display unit and the left midrange or woofer unit for regenerating high-note sound; and a right speaker including a right midrange or woofer unit disposed on the right side of the meter display unit for regenerating midrange or low-note sound and a right tweeter unit disposed between the meter display unit and the right midrange or woofer unit for regenerating high-note sound, a navigational system projecting from a front of the meter display unit, the navigational system having a display unit between the left and right speakers and being behind the meter display unit, wherein the left midrange or woofer unit, the left tweeter unit, the right midrange or woofer unit and the right tweeter unit are arranged in an instrument panel, wherein each of the left and right tweeter units includes a housing provided separate and apart from the corresponding left and right midrange or woofer unit, and wherein the acoustic system further includes:

a baffle surrounding each tweeter, each tweeter mounted in a panel, a first pin extending between the tweeter and baffle, allowing rotation about the first pin, and a second pin extending between the baffle and panel, allowing rotation about the second pin.

9. The acoustic system according to claim 8, wherein the left and right tweeter units are arranged below extensions, which are drawn so as to extend in lateral directions from an upper ridge line of an outline of the meter display unit.

10. The acoustic system according to claim 8, wherein an audio device is connected to the left and right midrange or woofer units and the left and right tweeter units.

11. The acoustic system according to claim 8, and further including a super woofer unit for regenerating a frequency range lower than the left and right midrange or woofer units, said super woofer unit being disposed in a trunk box.

12. The acoustic system according to claim 11, and further including a component selected from the group consisting of a tuner, a compact disc deck, a mini disc deck, a cassette deck and an amplifier, said component being disposed in the trunk box.

13. The acoustic system according to claim 8, wherein the housings of the left and right tweeter units extend beyond a topmost point of the meter display unit.

14. In a motorcycle comprising:

a fairing;

a meter display unit in the fairing for displaying drive information;

a motorcycle acoustic system comprising:

a left speaker including:

a left midrange or woofer unit disposed on the left side of the meter display unit for regenerating midrange or low-note sounds, and a left tweeter unit disposed between the meter display unit and the left midrange or woofer unit for regenerating high-note sounds, and a right speaker including:

a right midrange or woofer unit disposed on the right side of the meter display unit for regenerating midrange or low-note sounds, and a right tweeter unit disposed between the meter display unit and the right midrange or woofer unit for regenerating high-note sounds, a navigational system projecting from a front of the meter display unit, the navigational system having a display unit between the left and right speakers and being behind the meter display unit, wherein the meter display unit is disposed between the left and right tweeter units, and the tweeter units are disposed above and closer together than the midrange or woofer units, wherein each of the left and right tweeter units includes a housing provided separate and apart from the corresponding left and right midrange or woofer unit, and wherein the motorcycle acoustic system further includes:

a baffle surrounding each tweeter, each tweeter mounted in a cover member;

a first pin extending between the tweeter and baffle, allowing rotation about the first pin, and a second pin extending between the baffle and cover member, allowing rotation about the second pin.

15. The motorcycle acoustic system according to claim 14, wherein the left and right tweeter units are mounted for rotation about two axes.

16. The motorcycle acoustic system according to claim 14, wherein the housings of the left and right tweeter units extend beyond a topmost point of the meter display unit.

17. The motorcycle according to claim 14, wherein the housings of the left and right tweeter units extend upward from an upper ridge line of an outline of the meter display unit.

* * * * *